US010190366B2

(12) United States Patent
Zahradnik et al.

(10) Patent No.: US 10,190,366 B2
(45) Date of Patent: Jan. 29, 2019

(54) HYBRID DRILL BITS HAVING INCREASED DRILLING EFFICIENCY

(71) Applicant: BAKER HUGHES INCORPORATED, Houston, TX (US)

(72) Inventors: Anton F. Zahradnik, Sugar Land, TX (US); Robert J. Buske, The Woodlands, TX (US); Rudolf C. Pessier, Houston, TX (US); Don Q. Nguyen, Houston, TX (US); Karlos Cepeda, Houston, TX (US); Michael S. Damschen, Houston, TX (US); Mitchell A. Rothe, Montgomery, TX (US); Johnathan Howard, Conroe, TX (US); Gregory C. Prevost, Spring, TX (US); Chaitanya K. Vempati, Conroe, TX (US); John F. Bradford, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 99 days.

(21) Appl. No.: 15/137,294

(22) Filed: Apr. 25, 2016

(65) Prior Publication Data

US 2016/0251902 A1 Sep. 1, 2016

Related U.S. Application Data

(63) Continuation of application No. 13/678,521, filed on Nov. 15, 2012, now Pat. No. 9,353,575.
(Continued)

(51) Int. Cl.
*E21B 10/14* (2006.01)
*E21B 7/00* (2006.01)
(Continued)

(52) U.S. Cl.
CPC ..... *E21B 10/14* (2013.01); *E21B 7/00* (2013.01); *E21B 10/16* (2013.01); *E21B 10/18* (2013.01);
(Continued)

(58) Field of Classification Search
CPC ..... E21B 10/14
See application file for complete search history.

(56) References Cited

U.S. PATENT DOCUMENTS 930,759 A 8/1908 Hughes
1,388,424 A 9/1921 George
(Continued)

FOREIGN PATENT DOCUMENTS

DE 1301784 8/1969
EP 0225101 6/1987
(Continued)

OTHER PUBLICATIONS

Baharlou, International Preliminary Report of Patentability for International Patent Application No. PCT/US2009/050672, The International Bureau of WIPO, dated Jan. 25, 2011.
(Continued)

*Primary Examiner* — John J Kreck
(74) *Attorney, Agent, or Firm* — TraskBritt

(57) ABSTRACT

An earth-boring drill bit is described, the bit having a bit body having a central longitudinal axis that defines an axial center of the bit body and configured at its upper extent for connection into a drill string; at least one primary fixed blade extending downwardly from the bit body and inwardly toward, but not proximate to, the central axis of the drill bit; at least one secondary fixed blade extending radially outward from proximate the central axis of the drill bit; a plurality of fixed cutting elements secured to the primary and secondary fixed blades; at least one bit leg secured to the
(Continued)

bit body; and a rolling cutter mounted for rotation on the bit leg; wherein the fixed cutting elements on at least one fixed blade extend from a center of the bit outward toward a gage region of the bit but do not include a gage cutting region, and wherein at least one roller-cone cutter portion extends from substantially the drill bit's gage region inwardly toward the center of the bit, an apex of the roller-cone cutter being proximate to the terminal end of the at least one secondary fixed blade, but does not extend to the center of the bit.

20 Claims, 22 Drawing Sheets

Related U.S. Application Data

(60) Provisional application No. 61/560,083, filed on Nov. 15, 2011.

(51) Int. Cl.

| | |
|---|---|
| ***E21B 10/16*** | (2006.01) |
| ***E21B 10/18*** | (2006.01) |
| ***E21B 10/22*** | (2006.01) |
| ***E21B 10/28*** | (2006.01) |
| ***E21B 10/52*** | (2006.01) |
| ***E21B 10/26*** | (2006.01) |
| *E21B 10/55* | (2006.01) |

(52) U.S. Cl.
CPC ..... *E21B 10/22* (2013.01); *E21B 10/26* (2013.01); *E21B 10/28* (2013.01); *E21B 10/52* (2013.01); *E21B 10/55* (2013.01)

(56) References Cited

U.S. PATENT DOCUMENTS 1,394,769 A 10/1921 Sorensen
1,519,641 A 12/1924 Thompson
1,537,550 A 5/1925 Reed
1,729,062 A 9/1929 Bull
1,801,720 A 4/1931 Bull
1,816,568 A 7/1931 Carlson
1,821,474 A 9/1931 Mercer
1,874,066 A 8/1932 Scott et al.
1,879,127 A 9/1932 Schlumpf
1,896,243 A 2/1933 MacDonald
1,932,487 A 10/1933 Scott
2,030,722 A 2/1936 Scott
2,117,481 A 5/1938 Howard et al.
2,119,618 A 6/1938 Zublin
2,184,067 A 12/1939 Zublin
2,198,849 A 4/1940 Waxler
2,204,657 A 6/1940 Clyde
2,216,894 A 10/1940 Stancliff
2,244,537 A 6/1941 Kammerer
2,297,157 A 9/1942 McClinton
2,318,370 A 5/1943 Burch
2,320,136 A * 5/1943 Kammerer ..... E21B 10/08 175/333
2,320,137 A 5/1943 Kammerer
2,358,642 A 9/1944 Kammerer
2,380,112 A 7/1945 Kinnear
2,533,259 A 6/1946 Woods et al.
2,520,517 A 8/1950 Taylor
2,533,258 A 12/1950 Morlan et al.
2,557,302 A 6/1951 Maydew
RE23,416 E 10/1951 Kinnear
2,575,438 A 11/1951 Alexander et al.
2,628,821 A 2/1953 Alexander et al.
2,661,931 A * 12/1953 Swart ..... E21B 10/14 175/333
2,719,026 A * 9/1955 Boice ..... E21B 10/14 175/336
2,725,215 A * 11/1955 MacNeir ..... E21B 4/10 175/298
2,815,932 A 12/1957 Wolfram
2,994,389 A 8/1961 Bus, Sr.
3,010,708 A 11/1961 Hlinsky et al.
3,039,503 A 6/1962 Mainone
3,050,293 A 8/1962 Hlinsky
3,055,443 A 9/1962 Edwards
3,066,749 A 12/1962 Hildebrandt
3,126,066 A 3/1964 Williams, Jr.
3,126,067 A 3/1964 Schumacher, Jr.
3,174,564 A 3/1965 Morlan
3,239,431 A 3/1966 Raymond
3,250,337 A 5/1966 Demo
3,269,469 A 8/1966 Kelly, Jr.
3,387,673 A 6/1968 Thompson
3,397,751 A 8/1968 Reichmuth
3,424,258 A 1/1969 Nakayama
3,583,501 A 6/1971 Aalund
3,760,894 A 9/1973 Pitifer
RE28,625 E 11/1975 Cunningham
4,006,788 A 2/1977 Garner
4,108,259 A 8/1978 Dixon et al.
4,140,189 A 2/1979 Garner
4,190,126 A 2/1980 Kabashima
4,190,301 A 2/1980 Lachonius et al.
4,187,922 A 12/1980 Phelps
4,260,203 A 4/1981 Garner
4,270,812 A 6/1981 Thomas
4,285,409 A 8/1981 Allen
4,293,048 A 10/1981 Kloesel, Jr.
4,314,132 A 2/1982 Porter
4,320,808 A 3/1982 Garrett
4,343,371 A 8/1982 Baker, III et al.
4,359,112 A 11/1982 Garner et al.
4,359,114 A 11/1982 Miller et al.
4,369,849 A 1/1983 Parrish
4,386,669 A 6/1983 Evans
4,408,671 A 10/1983 Munson
4,410,284 A 10/1983 Herrick
4,428,687 A 1/1984 Zahradnik
4,444,281 A * 4/1984 Schumacher, Jr. ..... E21B 10/14 175/336
4,448,269 A * 5/1984 Ishikawa ..... E21B 10/14 175/335
4,456,082 A 6/1984 Harrison
4,468,138 A 8/1984 Nagel
4,527,637 A 7/1985 Bodine
4,527,644 A 7/1985 Allam
4,572,306 A 2/1986 Dorosz
4,600,064 A 7/1986 Scales et al.
4,627,882 A 12/1986 Soderstrom
4,641,718 A 2/1987 Bengtsson
4,657,091 A 4/1987 Higdon
4,664,705 A 5/1987 Horton et al.
4,690,228 A 9/1987 Voelz et al.
4,706,765 A 11/1987 Lee et al.
4,726,718 A 2/1988 Meskin et al.
4,727,942 A 3/1988 Galle et al.
4,729,440 A 3/1988 Hall
4,738,322 A 4/1988 Hall et al.
4,756,631 A 7/1988 Jones
4,763,736 A 8/1988 Varel
4,765,205 A 8/1988 Higdon
4,802,539 A 2/1989 Hall et al.
4,819,703 A 4/1989 Rice et al.
4,825,964 A 5/1989 Rives
4,865,137 A 9/1989 Bailey et al.
4,874,047 A 10/1989 Hixon
4,875,532 A 10/1989 Langford, Jr.
4,880,068 A 11/1989 Bronson
4,892,159 A 1/1990 Holster
4,892,420 A 1/1990 Kruger
4,915,181 A 4/1990 Labrosse
4,932,484 A 6/1990 Warren et al.
4,936,398 A 6/1990 Auty et al.
4,943,488 A 7/1990 Sung et al.
4,953,641 A 9/1990 Pessier
4,976,324 A 12/1990 Tibbitts

(56) References Cited

U.S. PATENT DOCUMENTS

| | | | |
|---|---|---|---|
| 4,981,184 | A | 1/1991 | Knowlton et al. |
| 4,984,643 | A | 1/1991 | Isbell et al. |
| 4,991,670 | A | 2/1991 | Fuller et al. |
| 4,991,671 | A | 2/1991 | Pearce et al. |
| 5,016,718 | A | 5/1991 | Tandberg |
| 5,027,912 | A | 7/1991 | Juergens |
| 5,027,914 | A | 7/1991 | Wilson |
| 5,028,177 | A | 7/1991 | Meskin et al. |
| 5,030,276 | A | 7/1991 | Sung et al. |
| 5,037,212 | A | 8/1991 | Justman et al. |
| 5,049,164 | A | 9/1991 | Horton et al. |
| 5,092,687 | A | 3/1992 | Hall |
| 5,116,568 | A | 5/1992 | Sung et al. |
| 5,137,097 | A | 8/1992 | Fernandez |
| 5,145,017 | A | 9/1992 | Holster et al. |
| 5,176,212 | A | 1/1993 | Tandberg |
| 5,199,516 | A | 4/1993 | Fernandez |
| 5,224,560 | A | 7/1993 | Fernandez |
| 5,238,074 | A | 8/1993 | Tibbitts et al. |
| 5,253,939 | A | 10/1993 | Hall |
| 5,287,936 | A | 2/1994 | Grimes et al. |
| 5,289,889 | A | 3/1994 | Gearhart et al. |
| 5,337,843 | A | 8/1994 | Torgrimsen et al. |
| 5,342,129 | A | 8/1994 | Dennis et al. |
| 5,346,026 | A | 9/1994 | Pessier et al. |
| 5,351,770 | A | 10/1994 | Cawthorne et al. |
| 5,361,859 | A | 11/1994 | Tibbitts |
| 5,429,200 | A | 7/1995 | Blackman et al. |
| 5,439,067 | A | 8/1995 | Huffstutler |
| 5,439,068 | A | 8/1995 | Huffstutler et al. |
| 5,452,771 | A | 9/1995 | Blackman et al. |
| 5,467,836 | A | 11/1995 | Grimes et al. |
| 5,472,057 | A | 12/1995 | Winfree |
| 5,472,271 | A | 12/1995 | Bowers et al. |
| 5,494,123 | A | 2/1996 | Nguyen |
| 5,513,715 | A | 5/1996 | Dysart |
| 5,518,077 | A | 5/1996 | Blackman et al. |
| 5,531,281 | A | 7/1996 | Murdock |
| 5,547,033 | A | 8/1996 | Campos, Jr. |
| 5,553,681 | A | 9/1996 | Huffstutler et al. |
| 5,558,170 | A | 9/1996 | Thigpen et al. |
| 5,560,440 | A | 10/1996 | Tibbitts |
| 5,570,750 | A | 11/1996 | Williams |
| 5,593,231 | A | 1/1997 | Ippolito |
| 5,595,255 | A | 1/1997 | Huffstutler |
| 5,606,895 | A | 3/1997 | Huffstutler |
| 5,624,002 | A | 4/1997 | Huffstutler |
| 5,641,029 | A | 6/1997 | Beaton et al. |
| 5,644,956 | A | 7/1997 | Blackman et al. |
| 5,655,612 | A | 8/1997 | Grimes et al. |
| D384,084 | S | 9/1997 | Huffstutler et al. |
| 5,695,018 | A | 12/1997 | Pessier et al. |
| 5,695,019 | A | 12/1997 | Shamburger, Jr. |
| 5,755,297 | A | 5/1998 | Young et al. |
| 5,839,526 | A | 11/1998 | Cisneros et al. |
| 5,862,871 | A | 1/1999 | Curlett |
| 5,868,502 | A | 2/1999 | Cariveau et al. |
| 5,873,422 | A | 2/1999 | Hansen et al. |
| 5,941,322 | A | 8/1999 | Stephenson et al. |
| 5,944,125 | A | 8/1999 | Byrd |
| 5,967,246 | A | 10/1999 | Caraway et al. |
| 5,979,576 | A | 11/1999 | Hansen et al. |
| 5,988,303 | A | 11/1999 | Arfele |
| 5,992,542 | A | 11/1999 | Rives |
| 5,996,713 | A | 12/1999 | Pessier et al. |
| 6,045,029 | A | 4/2000 | Scott |
| 6,068,070 | A | 5/2000 | Scott |
| 6,092,613 | A | 7/2000 | Caraway et al. |
| 6,095,265 | A | 8/2000 | Alsup |
| 6,109,375 | A | 8/2000 | Tso |
| 6,116,357 | A | 9/2000 | Wagoner et al. |
| 6,170,582 | B1 | 1/2001 | Singh et al. |
| 6,173,797 | B1 | 1/2001 | Dykstra et al. |
| 6,190,050 | B1 | 2/2001 | Campbell |
| 6,209,185 | B1 | 4/2001 | Scott |
| 6,220,374 | B1 | 4/2001 | Crawford |
| 6,241,034 | B1 | 6/2001 | Steinke et al. |
| 6,241,036 | B1 | 6/2001 | Lovato et al. |
| 6,250,407 | B1 | 6/2001 | Karlsson |
| 6,260,635 | B1 | 7/2001 | Crawford |
| 6,279,671 | B1 | 8/2001 | Panigrahi et al. |
| 6,283,233 | B1 | 9/2001 | Lamine et al. |
| 6,296,069 | B1 | 10/2001 | Lamine et al. |
| RE37,450 | E | 11/2001 | Deken et al. |
| 6,345,673 | B1 | 2/2002 | Siracki |
| 6,360,831 | B1 | 3/2002 | Akesson et al. |
| 6,367,568 | B2 | 4/2002 | Steinke et al. |
| 6,386,302 | B1 | 5/2002 | Beaton |
| 6,401,844 | B1 | 6/2002 | Doster et al. |
| 6,405,811 | B1 | 6/2002 | Borchardt |
| 6,408,958 | B1 | 6/2002 | Isbell et al. |
| 6,415,687 | B2 | 7/2002 | Saxman |
| 6,427,791 | B1 | 8/2002 | Glowka |
| 6,427,798 | B1 | 8/2002 | Imashige |
| 6,439,326 | B1 | 8/2002 | Huang et al. |
| 6,446,739 | B1 | 9/2002 | Richman et al. |
| 6,450,270 | B1 | 9/2002 | Saxton |
| 6,460,635 | B1 | 10/2002 | Kalsi et al. |
| 6,474,424 | B1 | 11/2002 | Saxman |
| 6,510,906 | B1 | 1/2003 | Richert et al. |
| 6,510,909 | B2 | 1/2003 | Portwood et al. |
| 6,527,066 | B1 | 3/2003 | Rives |
| 6,533,051 | B1 | 3/2003 | Singh et al. |
| 6,544,308 | B2 | 4/2003 | Griffin et al. |
| 6,561,291 | B2 | 5/2003 | Xiang |
| 6,562,462 | B2 | 5/2003 | Griffin et al. |
| 6,568,490 | B1 | 5/2003 | Tso et al. |
| 6,581,700 | B2 | 6/2003 | Curlett et al. |
| 6,585,064 | B2 | 7/2003 | Griffin et al. |
| 6,589,640 | B2 | 7/2003 | Griffin et al. |
| 6,592,985 | B2 | 7/2003 | Griffin et al. |
| 6,601,661 | B2 | 8/2003 | Baker et al. |
| 6,601,662 | B2 | 8/2003 | Matthias et al. |
| 6,637,528 | B2 | 10/2003 | Nishiyama et al. |
| 6,684,966 | B2 | 2/2004 | Lin et al. |
| 6,684,967 | B2 | 2/2004 | Mensa-Wilmot et al. |
| 6,729,418 | B2 | 5/2004 | Slaughter, Jr. et al. |
| 6,739,214 | B2 | 5/2004 | Griffin et al. |
| 6,742,607 | B2 | 6/2004 | Beaton |
| 6,745,858 | B1 | 6/2004 | Estes |
| 6,749,033 | B2 | 6/2004 | Griffin et al. |
| 6,797,326 | B2 | 9/2004 | Griffin et al. |
| 6,823,951 | B2 | 11/2004 | Yong et al. |
| 6,843,333 | B2 | 1/2005 | Richert et al. |
| 6,861,098 | B2 | 3/2005 | Griffin et al. |
| 6,861,137 | B2 | 3/2005 | Griffin et al. |
| 6,878,447 | B2 | 4/2005 | Griffin et al. |
| 6,883,623 | B2 | 4/2005 | McCormick et al. |
| 6,902,014 | B1 | 6/2005 | Estes |
| 6,922,925 | B2 | 8/2005 | Watanabe et al. |
| 6,986,395 | B2 | 1/2006 | Chen |
| 6,988,569 | B2 | 1/2006 | Lockstedt et al. |
| 7,096,978 | B2 | 8/2006 | Dykstra et al. |
| 7,111,694 | B2 | 9/2006 | Beaton |
| 7,128,173 | B2 | 10/2006 | Lin |
| 7,137,460 | B2 | 11/2006 | Slaughter, Jr. et al. |
| 7,152,702 | B1 | 12/2006 | Bhome et al. |
| 7,197,806 | B2 | 4/2007 | Boudreaux et al. |
| 7,198,119 | B1 | 4/2007 | Hall et al. |
| 7,234,549 | B2 | 6/2007 | McDonough et al. |
| 7,234,550 | B2 | 6/2007 | Azar et al. |
| 7,270,196 | B2 | 9/2007 | Hall |
| 7,281,592 | B2 | 10/2007 | Runia et al. |
| 7,292,967 | B2 | 11/2007 | McDonough et al. |
| 7,311,159 | B2 | 12/2007 | Lin et al. |
| 7,320,375 | B2 | 1/2008 | Singh |
| 7,341,119 | B2 | 3/2008 | Singh |
| 7,350,568 | B2 | 4/2008 | Mandal et al. |
| 7,350,601 | B2 | 4/2008 | Belnap et al. |
| 7,360,612 | B2 | 4/2008 | Chen et al. |
| 7,377,341 | B2 | 5/2008 | Middlemiss et al. |
| 7,387,177 | B2 | 6/2008 | Zahradnik et al. |
| 7,392,862 | B2 | 7/2008 | Zahradnik et al. |
| 7,398,837 | B2 | 7/2008 | Hall et al. |

(56) References Cited

U.S. PATENT DOCUMENTS

| | | | |
|---|---|---|---|
| 7,416,036 | B2 | 8/2008 | Forstner et al. |
| 7,435,478 | B2 | 10/2008 | Keshavan |
| 7,458,430 | B2 | 12/2008 | Fyfe |
| 7,462,003 | B2 | 12/2008 | Middlemiss |
| 7,473,287 | B2 | 1/2009 | Belnap et al. |
| 7,493,973 | B2 | 2/2009 | Keshavan et al. |
| 7,517,589 | B2 | 4/2009 | Eyre |
| 7,533,740 | B2 | 5/2009 | Zhang et al. |
| 7,559,695 | B2 | 7/2009 | Sexton et al. |
| 7,568,534 | B2 | 8/2009 | Griffin et al. |
| 7,621,346 | B1 | 11/2009 | Trinh et al. |
| 7,621,348 | B2 | 11/2009 | Hoffmaster et al. |
| 7,647,991 | B2 | 1/2010 | Felderhoff |
| 7,703,556 | B2 | 4/2010 | Smith et al. |
| 7,703,557 | B2 | 4/2010 | Durairajan et al. |
| 7,819,208 | B2 | 10/2010 | Pessier et al. |
| 7,836,975 | B2 | 11/2010 | Chen et al. |
| 7,845,435 | B2 | 12/2010 | Zahradnik et al. |
| 7,845,437 | B2 | 12/2010 | Bielawa et al. |
| 7,847,437 | B2 | 12/2010 | Chakrabarti et al. |
| 7,992,658 | B2 | 8/2011 | Buske |
| 8,056,651 | B2 | 11/2011 | Turner |
| 8,177,000 | B2 | 5/2012 | Bhome et al. |
| 8,201,646 | B2 | 6/2012 | Vezirian |
| 8,302,709 | B2 | 11/2012 | Bhome et al. |
| 8,356,398 | B2 | 1/2013 | McCormick et al. |
| 8,950,514 | B2 | 2/2015 | Buske et al. |
| 9,353,575 | B2 * | 5/2016 | Zahradnik ..... E21B 7/00 |
| 2001/0000885 | A1 | 5/2001 | Beuershausen et al. |
| 2001/0030066 | A1 | 10/2001 | Clydesdale et al. |
| 2002/0092684 | A1 | 7/2002 | Singh et al. |
| 2002/0100618 | A1 | 8/2002 | Watson et al. |
| 2002/0108785 | A1 | 8/2002 | Slaughter, Jr. et al. |
| 2004/0031625 | A1 | 2/2004 | Lin et al. |
| 2004/0099448 | A1 | 5/2004 | Fielder et al. |
| 2004/0238224 | A1 | 12/2004 | Runia |
| 2005/0087370 | A1 | 4/2005 | Ledgerwood, III et al. |
| 2005/0103533 | A1 | 5/2005 | Sherwood, Jr. et al. |
| 2005/0167161 | A1 | 8/2005 | Aaron |
| 2005/0178587 | A1 | 8/2005 | Witman, IV et al. |
| 2005/0183892 | A1 | 8/2005 | Oldham et al. |
| 2005/0252691 | A1 | 11/2005 | Bramlett et al. |
| 2005/0263328 | A1 | 12/2005 | Middlemiss |
| 2005/0273301 | A1 | 12/2005 | Huang |
| 2006/0027401 | A1 | 2/2006 | Nguyen |
| 2006/0032674 | A1 | 2/2006 | Chen et al. |
| 2006/0032677 | A1 | 2/2006 | Azar et al. |
| 2006/0162969 | A1 | 7/2006 | Belnap et al. |
| 2006/0196699 | A1 | 9/2006 | Estes et al. |
| 2006/0254830 | A1 | 11/2006 | Radtke |
| 2006/0266558 | A1 | 11/2006 | Middlemiss et al. |
| 2006/0266559 | A1 | 11/2006 | Keeshavan et al. |
| 2006/0283640 | A1 | 12/2006 | Estes et al. |
| 2007/0029114 | A1 | 2/2007 | Middlemiss |
| 2007/0034414 | A1 | 2/2007 | Singh et al. |
| 2007/0046119 | A1 | 3/2007 | Cooley |
| 2007/0062736 | A1 | 3/2007 | Cariveau et al. |
| 2007/0079994 | A1 | 4/2007 | Middlemiss |
| 2007/0084640 | A1 | 4/2007 | Singh |
| 2007/0131457 | A1 | 6/2007 | McDonough et al. |
| 2007/0187155 | A1 | 8/2007 | Middlemiss |
| 2007/0221417 | A1 | 9/2007 | Hall et al. |
| 2007/0227781 | A1 | 10/2007 | Cepeda et al. |
| 2007/0272445 | A1 | 11/2007 | Cariveau |
| 2008/0028891 | A1 | 2/2008 | Calnan et al. |
| 2008/0029308 | A1 | 2/2008 | Chen |
| 2008/0066970 | A1 | 3/2008 | Zahradnik et al. |
| 2008/0087471 | A1 | 4/2008 | Chen et al. |
| 2008/0093128 | A1 | 4/2008 | Zahradnik et al. |
| 2008/0156543 | A1 | 7/2008 | McDonough et al. |
| 2008/0164069 | A1 | 7/2008 | McDonough et al. |
| 2008/0264695 | A1 | 10/2008 | Zahradnik et al. |
| 2008/0296068 | A1 | 12/2008 | Zahradnik et al. |
| 2008/0308320 | A1 | 12/2008 | Kolachalam |
| 2009/0044984 | A1 | 2/2009 | Massey et al. |
| 2009/0114454 | A1 | 5/2009 | Belnap et al. |
| 2009/0120693 | A1 | 5/2009 | McClain et al. |
| 2009/0126998 | A1 * | 5/2009 | Zahradnik ..... E21B 10/14 175/57 |
| 2009/0159338 | A1 | 6/2009 | Buske |
| 2009/0159341 | A1 | 6/2009 | Pessier et al. |
| 2009/0166093 | A1 | 7/2009 | Pessier et al. |
| 2009/0178855 | A1 | 7/2009 | Zhang et al. |
| 2009/0178856 | A1 | 7/2009 | Singh et al. |
| 2009/0183925 | A1 | 7/2009 | Zhang et al. |
| 2009/0236147 | A1 | 9/2009 | Koltermann et al. |
| 2009/0272582 | A1 | 11/2009 | McCormick et al. |
| 2009/0283332 | A1 | 11/2009 | Dick et al. |
| 2010/0012392 | A1 | 1/2010 | Zahradnik et al. |
| 2010/0018777 | A1 | 1/2010 | Pessier et al. |
| 2010/0043412 | A1 | 2/2010 | Dickinson et al. |
| 2010/0155146 | A1 | 6/2010 | Nguyen et al. |
| 2010/0224417 | A1 | 9/2010 | Zahradnik et al. |
| 2010/0252326 | A1 | 10/2010 | Bhome et al. |
| 2010/0276205 | A1 | 11/2010 | Oxford et al. |
| 2010/0288561 | A1 | 11/2010 | Zahradnik et al. |
| 2010/0320001 | A1 | 12/2010 | Kulkarni |
| 2011/0024197 | A1 | 2/2011 | Centala et al. |
| 2011/0079440 | A1 | 4/2011 | Buske et al. |
| 2011/0079441 | A1 | 4/2011 | Buske et al. |
| 2011/0079442 | A1 | 4/2011 | Buske et al. |
| 2011/0079443 | A1 | 4/2011 | Buske et al. |
| 2011/0085877 | A1 | 4/2011 | Osborne, Jr. |
| 2011/0162893 | A1 * | 7/2011 | Zhang ..... E21B 10/08 175/428 |
| 2011/0283628 | A1 | 11/2011 | Saridikmen et al. |
| 2012/0111638 | A1 | 5/2012 | Nguyen et al. |
| 2012/0205160 | A1 | 8/2012 | Ricks et al. |
| 2015/0152687 | A1 | 6/2015 | Nguyen et al. |
| 2015/0197992 | A1 | 7/2015 | Ricks et al. |
| 2015/0211303 | A1 | 7/2015 | Buske et al. |

FOREIGN PATENT DOCUMENTS

| | | |
|---|---|---|
| EP | 0157278 | 11/1989 |
| EP | 0391683 | 1/1996 |
| EP | 0874128 | 10/1998 |
| EP | 2089187 | 8/2009 |
| GB | 2183694 | 6/1987 |
| GB | 2194571 | 3/1988 |
| GB | 2364340 | 1/2002 |
| GB | 2403313 | 12/2004 |
| JP | 2001159289 | 6/2001 |
| RU | 1331988 | 8/1987 |
| WO | 8502223 | 5/1985 |
| WO | 2008124572 | 10/2008 |
| WO | 2009135119 | 11/2009 |
| WO | 2010/135605 A2 | 11/2010 |
| WO | 2010127382 | 11/2010 |
| WO | 2015/102891 A1 | 7/2015 |

OTHER PUBLICATIONS

Becamel, International Preliminary Report on Patentability for the International Patent Application No. PCT/US2010/039100, The International Bureau of WIPO, Switzerland, dated Jan. 5, 2012.

Beijer, International Preliminary Report on Patentability for International Patent Application No. PCT/US2009/042514 The International Bureau of WIPO, dated Nov. 2, 2010.

Buske, et al., "Performance Paradigm Shift: Drilling Vertical and Directional Sections Through Abrasive Formations with Roller Cone Bits", Society of Petroleum Engineers—SPE 114975 CIPC/SPE Gas Technology Symposium 2008 Joint Conference Canada, dated Jun. 16-19, 2008.

Choi, International Search Report for International Patent Application No. PCT/US2010/0039100, Korean Intellectual Property Office, dated Jan. 25, 2011.

Choi, Written Opinion for International Patent Application No. PCT/US2010/039100, Korean Intellectual Property Office, dated Jan. 25, 2011.

Dr. Wells, et al., "Bit Balling Mitigation in PDC Bit Design", International Association of Drilling Contractors/ Society of Petro-

(56) References Cited

OTHER PUBLICATIONS leum Engineers—IADC/SPE 114673 IADC/SPE Asia Pacific Drilling Technology Conference and Exhibition Indonesia, dated Aug. 25-27, 2008.
Ersoy, et al., "Wear characteristics of PDC pin and hybrid core bits in rock drilling", Wear 188 Elsevier Science S.A., pp. 150-165, dated Mar. 1995.
George, et al., "Significant Cost Savings Achieved Through Out the Use of PDC Bits in Compressed Air/Foam Applications", Society of Petroleum Engineers—SPE 116118 2008 SPE Annual Technical Conference and Exhibition Denver, Colorado, dated Sep. 21-24, 2008.
Georgescu, Written Opinion for International Patent Application No. PCT/US2010/051020, European Patent Office dated Jun. 1, 2011.
Georgescu, International Search Report for International Patent Application No. PCT/US2010/050631, European Patent Office dated Jun. 10, 2011.
Georgescu, Written Opinion for International Patent Application No. PCT/US2010/050631, European Patent Office dated Jun. 10, 2011.
Georgescu, International Search Report for International Patent Application No. PCT/US2011/042437, European Patent Office dated Nov. 9, 2011.
Georgescu, Written Opinion for International Patent Application No. PCT/US2011/042437, European Patent Office dated Nov. 9, 2011.
Georgescu, International Search Report for International Patent Application No. PCT/US2010/051020, European Patent Office, dated Jun. 1, 2011.
Georgescu, International Search Report for International Patent Application No. PCT/US2010/051019, European Patent Office, dated Jun. 6, 2011.
Georgescu, Written Opinion for International Patent Application No. PCT/US2010/051019, European Patent Office, dated Jun. 6, 2011.
Georgescu, International Search Report for International Patent Application No. PCT/US2010/051017, European Patent Office, dated Jun. 8, 2011.
Georgescu, Written Opinion for International Patent Application No. PCT/US2010/051017, European Patent Office, dated Jun. 8, 2011.
Georgescu, International Search Report for International Patent Application No. PCT/US2010/051014, European Patent Office dated Jun. 9, 2011.
Georgescu, Written Opinion for International Patent Application No. PCT/US2010/051014, European Patent Office, dated Jun. 9, 2011.
Kang, International Search Report for International Patent Application No. PCT/US2010/033513, Korean Intellectual Property Office, dated Jan. 10, 2011.
Kang, Written Opinion for International Patent Application No. PCT/US2010/033513, Korean Intellectual Property Office, dated Jan. 10, 2011.
Kang, International Search Report for International Patent Application No. PCT/US2010/032511, Korean Intellectual Property Office, dated Jan. 17, 2011.
Kang, Written Opinion for International Patent Application No. PCT/US2010/032511, Korean Intellectual Property Office, dated Jan. 17, 2011.
Kim, International Search Report for International Patent Application No. PCT/US2009/067969, Korean Intellectual Property Office, dated May 25, 2010.
Kim, Written Opinion for International Patent Application No. PCT/US2009/067969, Korean Intellectual Property Office, dated May 25, 2010.
Lee, International Search Report for International Patent Application No. PCT/US2009/042514, Korean Intellectual Property Office dated Nov. 27, 2009.
Lee, Written Opinion for International Patent Application No. PCT/US2009/042514, Korean Intellectual Property Office dated Nov. 27, 2009.
Williams, et al., "An Analysis of the Performance of PDC Hybrid Drill Bits", SPE/IADC 16117, SPE/IADC Drilling Conference, pp. 585-594, dated Mar. 1987.
Lee, International Search Report for International Patent Application No. PCT/US2009/050672, Korean Intellectual Property Office dated Mar. 3, 2010.
Warren, et al., "PDC Bits: What's Needed to Meet Tomorrow's Challenge", SPE 27978, University of Tulsa Centennial Petroleum Engineering Symposium, pp. 207-214, dated Aug. 1994.
Lee, Written Opinion for International Patent Application No. PCT/US2009/050672, Korean Intellectual Office dated Mar. 3, 2010.
Tomlinson, et al., "Rock Drilling—Syndax3 Pins—New Concepts in PCD Drilling", Industrial Diamond Review, pp. 109-114, dated Mar. 1992.
Mills Machine Company, "Rotary Hole Openers—Section 8", Retrieved from the internet on May 7, 2009 using <URL: http://www.millsmachine.com/pages/home_page/mills_catalog/cat_holeopen/cat_holeopen.pdf>.
Ott, International Search Report for International Patent Application No. PCT/US2010/049159, European Patent Office, dated Apr. 21, 2011.
Ott, Written Opinion for International Patent Application No. PCT/US2010/049159, European Patent Office, dated Apr. 21, 2011.
Smith Services, "Hole Opener—Model 6980 Hole Opener", Retrieved from the internet on May 7, 2008 using <URL: http://www.siismithservices.com/b_products/product_page.asp?ID=589>.
Pessier, et al., "Hybrid Bits Offer Distinct Advantages in Selected Roller Cone and PDC Bit Applications", IADC/SPE Paper No. 128741, dated Feb. 2-4, 2010, pp. 1-9.
Schneiderbauer, International Search Report for International Patent Application No. PCT/US2012/024134, European Patent Office, dated Mar. 7, 2013.
Schneiderbauer, International Written Opinion for International Patent Application No. PCT/US2012/024134, European Patent Office, dated Mar. 7, 2013.
Schouten, International Search Report for International Patent Application No. PCT/US2008/083532 European Patent Office, dated Feb. 25, 2009.
Schouten, Written Opinion for International Patent Application No. PCT/US2008/083532, European Patent Office dated Feb. 25, 2009.
Sheppard, et al., "Rock Drilling—Hybrid Bit Success for Syndax3 Pins", Industrial Diamond Review, pp. 309-311, dated Jun. 1993.
Dantinne, P, International Search Report for International Patent Application No. PCT/US2015/032230, European Patent Office, dated Nov. 16, 2015.
Dantinne, P, Written Opinion for International Patent Application No. PCT/US2015/032230, European Patent Office, dated Nov. 16, 2015.
Written Opinion of the International Searching Authority for International Patent Application No. PCT/US2012/065277, dated Mar. 25, 2013, 4 pages.
Thomas, S., International Search Report for International Patent Application No. PCT/US2015/014011, USPTO, dated Apr. 24, 2015.
Thomas, S, International Written Opinion for International Application No. PCT.US2015/014011 dated Apr. 24, 2015.
R.C. pessier and M.J. Fear, "Quantifying Common Drilling Problems with Mechanical Specific Energy and a Bit Specific Coefficient of Sliding Frictino," SPE Conference Paper No. 24584 MS, 1992.
International Search Report for International Patent Application No. PCT/US2012/065277, dated Mar. 25, 2013, 3 pages.
Examination Report for GC Application No. 2012-22812 dated Oct. 26, 2016, 4 pages.
European Search Report for European Application No. 16201774.3 dated Feb. 8, 2017, 4 pages.
European Search Report for European Application No. 12849014.1 dated Jan. 7, 2016, 8 pages.
European Office Action for European Application No. 12849014.1 dated Feb. 3, 2017, 5 pages.

(56) References Cited

OTHER PUBLICATIONS

Chinese Second Office Action for Chinese Application No. 201280065328.0 dated Apr. 25, 2016, 5 pages.
Chinese First Office Action for Chinese Application No. 201280065328.0 dated Jul. 3, 2015, 11 pages.
Canadian Office Action for Canadian Application No. 2,855,947, dated Jul. 7, 2015, 4 pages.

* cited by examiner

HYBRID DRILL BITS HAVING INCREASED DRILLING EFFICIENCY

CROSS-REFERENCE TO RELATED APPLICATIONS

This application is a continuation of U.S. patent application Ser. No. 13/678,521, filed Nov. 15, 2012, now U.S. Pat. No. 9,353,575, issued May 31, 2016, which claims priority to U.S. Provisional Patent Application Ser. No. 61/560,083, filed Nov. 15, 2011, the disclosure of each of which is hereby incorporated herein in its entirety by this reference.

BACKGROUND

Field of the Invention

The inventions disclosed and taught herein relate generally to earth-boring drill bits and, more specifically, are related to improved earth-boring drill bits having a combination of fixed cutters and rolling cutters having cutting elements associated therewith, the arrangement of all of which exhibit improved drilling efficiency, as well as the operation of such bits.

Description of the Related Art

The present disclosure relates to systems and methods for excavating a earth formation, such as forming a wellbore for the purpose of oil and gas recovery, to construct a tunnel, or to form other excavations in which the earth formation is cut, milled, pulverized, scraped, sheared, indented, and/or fractured (hereinafter referred to collectively as "cutting"), as well as the apparatus used for such operations. The cutting process is a very interdependent process that typically integrates and considers many variables to ensure that a usable borehole is constructed. As is commonly known in the art, many variables have an interactive and cumulative effect of increasing cutting costs. These variables may include formation hardness, abrasiveness, pore pressures, and elastic properties of the formation itself. In drilling wellbores, formation hardness and a corresponding degree of drilling difficulty may increase exponentially as a function of increasing depth of the wellbore. A high percentage of the costs to drill a well are derived from interdependent operations that are time sensitive, i.e., the longer it takes to penetrate the formation being drilled, the more it costs. One of the most important factors affecting the cost of drilling a wellbore is the rate at which the formation can be penetrated by the drill bit, which typically decreases with harder and tougher formation materials and wellbore depth into the formation.

There are generally two categories of modern drill bits that have evolved from over a hundred years of development and untold amounts of dollars spent on the research, testing and iterative development. These are commonly known as the "fixed-cutter drill bit" and the "roller-cone drill bit." Within these two primary categories, there are a wide variety of variations, with each variation designed to drill a formation having a general range of formation properties. These two categories of drill bits generally constitute the bulk of the drill bits employed to drill oil and gas wells around the world.

Each type of drill bit is commonly used where its drilling economics are superior to the other. Roller-cone drill bits can drill the entire hardness spectrum of rock formations. Thus, roller-cone drill bits are generally run when encountering harder rocks where long bit life and reasonable penetration rates are important factors on the drilling economics. Fixed-cutter drill bits, including impregnated drill bits, are typically used to drill a wide variety of formations ranging from unconsolidated and weak rocks to medium hard rocks.

The roller-cone bit replaced the fishtail bit in the early 1900s as a more durable tool to drill hard and abrasive formations (Hughes 1915) but its limitations in drilling shale and other plastically behaving rocks were well known. The underlying cause was a combination of chip-hold-down and/or bottom balling [Murray et al., 1955], which becomes progressively worse at greater depth as borehole pressure and mud weight increase. Balling reduces drilling efficiency of roller-cone bits to a fraction of what is observed under atmospheric conditions (R.C. Pessier and M.J. Fear, "Quantifying Common Drilling Problems with Mechanical Specific Energy and a Bit-Specific Coefficient of Sliding Friction," SPE Conference Paper No. 24584-MS, 1992). Other phenomena such as tracking and off-center running further aggravate the problem. Many innovations in roller-cone bit design and hydraulics have addressed these issues but they have only marginally improved the performance (Wells and Pessier, 1993; Moffit et al., 1992). Fishtail or fixed-blade bits are much less affected by these problems since they act as mechanical scrapers that continuously scour the borehole bottom. The first prototype of a hybrid bit (Scott, 1930), which simply combines a fishtail and roller-cone bit, never succeeded commercially because the fishtail or fixed-blade part of the bit would prematurely wear and large wear flats reduced the penetration rate to even less than what was achievable with the roller-cone bit alone. The concept of the hybrid bit was revived with the introduction of the much more wear-resistant, fixed-cutter PDC (polycrystalline diamond compact) bits in the 1980s and a wide variety of designs were proposed and patented (Schumacher et al., 1984; Holster et al., 1992; Tandberg, 1992; Baker, 1982). Some were field tested but again with mixed results (Tandberg and Rodland, 1990), mainly due to structural deficiencies in the designs and the lack of durability of the first-generation PDC cutters. In the meantime, significant advances have been made in PDC cutter technology, and fixed-blade PDC bits have replaced roller-cone bits in all but some applications for which the roller-cone bits are uniquely suited. These are hard, abrasive and interbedded formations, complex directional drilling applications and, in general, applications in which the torque requirements of a conventional PDC bit exceed the capabilities of a given drilling system. It is in these applications where the hybrid bit can substantially enhance the performance of a roller-cone bit with a lower level of harmful dynamics compared to a conventional PDC bit.

In a hybrid-type drill bit, the intermittent crushing of a roller-cone bit is combined with continuous shearing and scraping of a fixed-blade bit. The characteristic drilling mechanics of a hybrid bit can be best illustrated by direct comparison to a roller-cone and fixed-blade bit in laboratory tests under controlled, simulated downhole conditions (L. W. Ledgerwood and J. L. Kelly, "High Pressure Facility Re-Creates Downhole Conditions in Testing of Full Size Drill Bits," SPE paper No. 91-PET-1, presented at the ASME Energy-sources Technology Conference and Exhibition, New Orleans, Jan. 20-24, 1991). The drilling mechanics of the different bit types and their performance are highly dependent on formation or rock type, structure and strength.

Early concepts of hybrid drill bits go back to the 1930s, but the development of a viable drilling tool has become feasible only with the recent advances in polycrystalline-diamond-compact (PDC) cutter technology. A hybrid bit can drill shale and other plastically behaving formations two to four times faster than a roller-cone bit by being more aggressive and efficient. The penetration rate of a hybrid bit responds linearly to revolutions per minute (RPM), unlike that of roller-cone bits that exhibit an exponential response with an exponent of less than unity. In other words, the hybrid bit will drill significantly faster than a comparable roller-cone bit in motor applications. Another benefit is the effect of the rolling cutters on the bit dynamics. Compared with conventional PDC bits, torsional oscillations are as much as 50% lower, and stick-slip is reduced at low RPM and whirl at high RPM. This gives the hybrid bit a wider operating window and greatly improves toolface control in directional drilling. The hybrid drill bit is a highly application-specific drill bit aimed at (1) traditional roller-cone applications that are rate-of-penetration (ROP) limited, (2) large-diameter PDC-bit and roller-cone-bit applications that are torque or weight-on-bit (WOB) limited, (3) highly interbedded formations where high torque fluctuations can cause premature failures and limit the mean operating torque, and (4) motor and/or directional applications where a higher ROP and better build rates and toolface control are desired. (R. Pessier and M. Damschen, "Hybrid Bits Offer Distinct Advantages in Selected Roller-Cone and PDC-Bit Applications," *SPE Drilling & Completion*, vol. 26 (1), pp. 96-103 (March 2011).)

In the early stages of drill bit development, some earth-boring bits use a combination of one or more rolling cutters and one or more fixed blades. Some of these combination-type drill bits are referred to as hybrid bits. Previous designs of hybrid bits, such as described in U.S. Pat. No. 4,343,371, to Baker, III, have provided for the rolling cutters to do most of the formation cutting, especially in the center of the hole or bit. Other types of combination bits are known as "core bits," such as U.S. Pat. No. 4,006,788, to Garner. Core bits typically have truncated rolling cutters that do not extend to the center of the bit and are designed to remove a core sample of formation by not just drilling down, but around, a solid cylinder of the formation to be removed from the borehole generally intact for purposes of formation analysis.

Another type of hybrid bit is described in U.S. Pat. No. 5,695,019, to Shamburger, Jr., wherein the rolling cutters extend almost entirely to the center. A rotary cone drill bit with two-stage cutting action is provided. The drill bit includes at least two truncated conical cutter assemblies rotatably coupled to support arms, where each cutter assembly is rotatable about a respective axis directed downwardly and inwardly. The truncated conical cutter assemblies are frustoconical or conical frustums in shape, with a back face connected to a flat truncated face by conical sides. The truncated face may or may not be parallel with the back face of the cutter assembly. A plurality of primary cutting elements or inserts are arranged in a predetermined pattern on the flat truncated face of the truncated conical cutter assemblies. The teeth of the cutter assemblies are not meshed or engaged with one another and the plurality of cutting elements of each cutter assembly is spaced from cutting elements of other cutter assemblies. The primary cutting elements cut around a conical core rock formation in the center of the borehole, which acts to stabilize the cutter assemblies and urges them outward to cut a full-gage borehole. A plurality of secondary cutting elements or inserts is mounted in the downward surfaces of a dome area of the bit body. The secondary cutting elements reportedly cut down the free-standing core rock formation when the drill bit advances.

More recently, hybrid drill bits having both roller cones and fixed blades with improved cutting profiles and bit mechanics have been described, as well as methods for drilling with such bits. For example, U.S. Pat. No. 7,845,435 to Zahradnik et al., describes a hybrid-type drill bit wherein the cutting elements on the fixed blades form a continuous cutting profile from the perimeter of the bit body to the axial center. The roller-cone cutting elements overlap with the fixed-blade cutting elements in the nose and shoulder sections of the cutting profile between the axial center and the perimeter. The roller-cone cutting elements crush and pre- or partially fracture formation in the confined and highly stressed nose and shoulder sections.

While the success of the most recent hybrid-type drill bits has been shown in the field, select, specifically designed hybrid drill bit configurations suffer from lack of efficient cleaning of both the PDC cutters on the fixed blades and the cutting elements on the roller cones, leading to issues such as decreased drilling efficiency and balling issues in certain softer formations. This lack of cleaning efficiency in selected hybrid drill bits can be the result of overcrowded junk slot volume, which, in turn, results in limited available space for nozzle placement and orientation, the same nozzle in some instances being used to clean both the fixed-blade cutters and the roller-cone cutting elements, and inadequate space for cuttings evacuation during drill bit operation.

The disclosures taught herein are directed to drill bits having a bit body, wherein the bit body includes primary and secondary fixed-cutter blades extending downward from the bit, bit legs extending downward from the bit body and terminating in roller cutter cones, wherein at least one of the fixed-cutter blades is in alignment with a rolling cutter.

BRIEF SUMMARY

The objects described above and other advantages and features of the disclosure are incorporated in the application as set forth herein, and the accompanying drawings, related to improved hybrid and pilot reamer-type earth-boring drill bits having both primary and secondary fixed-cutter blades and rolling cones depending from bit legs are described, the bits including inner fixed cutting blades that extend radially outward in substantial angular or linear alignment with at least one of the rolling cones mounted to the bit legs.

In accordance with one aspect of the present disclosure, an earth-boring drill bit is described, the bit having a bit body having a central longitudinal axis that defines an axial center of the bit body and configured at its upper extent for connection into a drill string; at least one fixed blade extending downwardly from the bit body; a plurality of fixed cutting elements secured to the fixed blade; at least one bit leg secured to the bit body; and a rolling cutter mounted for rotation on the bit leg; wherein the fixed cutting elements on at least one fixed blade extend from the center of the bit outward toward the gage of the bit but do not include a gage cutting region, and wherein at least one roller-cone cutter portion extends from substantially the drill bit's gage region inwardly toward the center of the bit, but does not extend to the center of the bit.

In accordance with a further aspect of the present disclosure, an earth-boring drill bit is described, the bit comprising a bit body having a central longitudinal axis that defines an axial center of the bit body and configured at its upper extent for connection into a drill string; at least one outer fixed blade extending downwardly from the bit body; a plurality of fixed cutting elements secured to the outer fixed blade and extending from the outer gage of the bit toward the axial center, but not extending to the axial center of the bit; at least one inner fixed blade extending downwardly from the bit body; a plurality of fixed cutting elements secured to the inner fixed blade and extending from substantially the center of the bit outwardly toward the gage of the bit, but not including the outer gage of the bit; at least one bit leg secured to the bit body; and a rolling cutter mounted for rotation on the bit leg having a heel portion near the gage region of the bit and an opposite roller shaft at the proximate end of the cutter; wherein the inner fixed blade extends substantially to the proximate end of the cutter. Such an arrangement forms a saddle-type arrangement, as illustrated generally in FIGS. 10 and 11, wherein the roller cone may have a central bearing extending through the cone only or, alternatively, in a removable fashion through the cone and into a recessed portion of the outer edge of the inner, secondary fixed-blade cutter.

In accordance with further embodiments of the present disclosure, an earth-boring drill bit for drilling a borehole in an earthen formation is described, the bit comprising a bit body configured at its upper extent for connection to a drill string, the bit body having a central axis and a bit face comprising a cone region, a nose region, a shoulder region, and a radially outermost gage region; at least one fixed blade extending downward from the bit body in the axial direction, the at least one fixed blade having a leading and a trailing edge; a plurality of fixed-blade cutting elements arranged on the at least one fixed blade; at least one rolling cutter mounted for rotation on the bit body; and a plurality of rolling-cutter cutting elements arranged on the at least one rolling cutter; wherein at least one fixed blade is in angular alignment with at least one rolling cutter. In further accordance with aspects of this embodiment, the at least one rolling cutter may include a substantially linear bearing or a rolling cone spindle having a distal end extending through and above the top face of the rolling cutter and sized and shaped to be removably insertable within a recess formed in a terminal face of the fixed blade in angular alignment with the rolling cutter, or within a recess formed in a saddle assembly that may or may not be integral with the angularly aligned fixed blade.

BRIEF DESCRIPTION OF THE DRAWINGS

The following figures form part of the present specification and are included to further demonstrate certain aspects of this disclosure. The disclosure may be better understood by reference to one or more of these figures in combination with the detailed description of specific embodiments presented herein.

Figure 1:
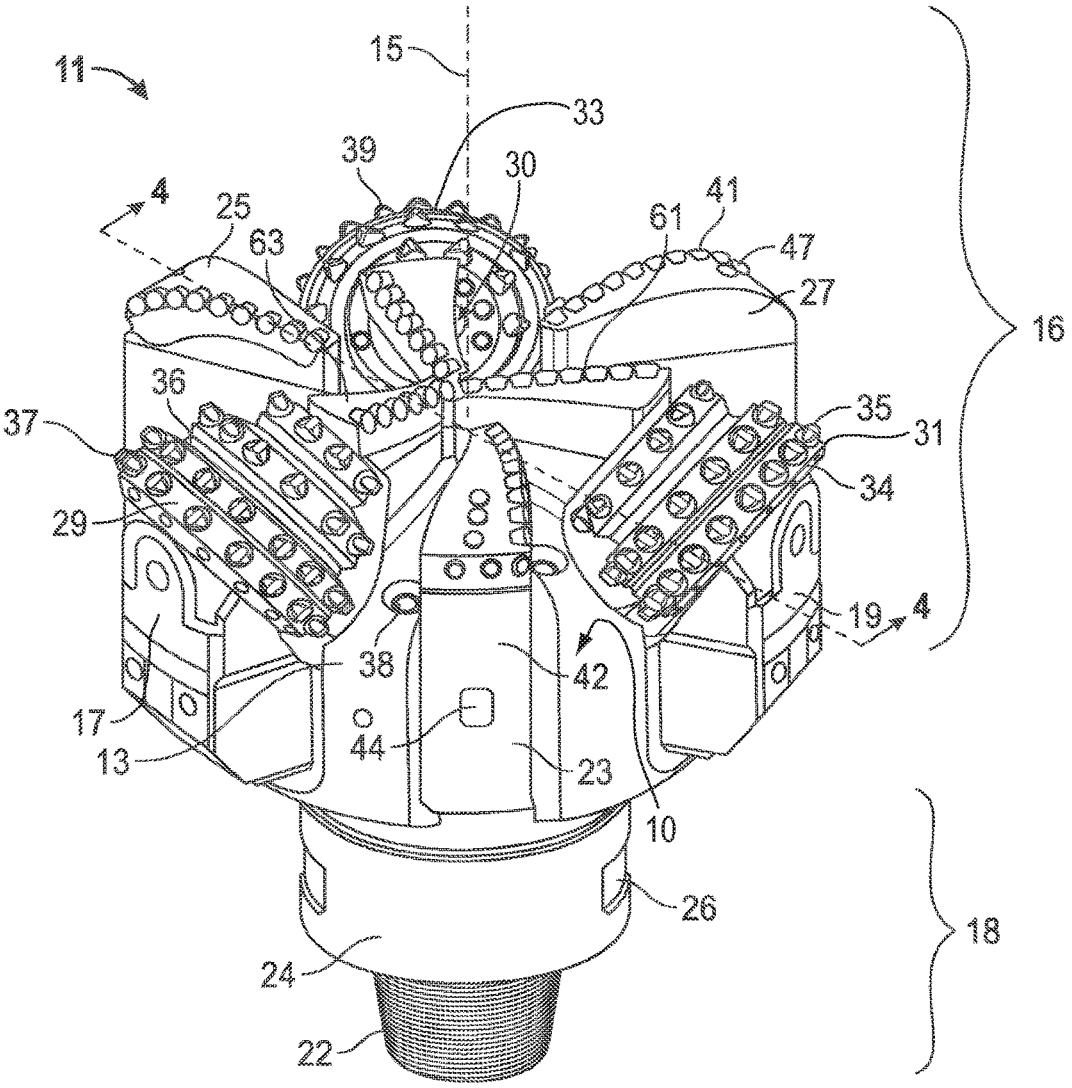
FIG. 1 illustrates a schematic isometric view of an exemplary drill bit in accordance with embodiments of the present disclosure.

While the disclosures described herein are susceptible to various modifications and alternative forms, only a few specific embodiments have been shown by way of example in the drawings and are described in detail below. The figures and detailed descriptions of these specific embodiments are not intended to limit the breadth or scope of the inventive concepts or the appended claims in any manner. Rather, the figures and detailed written descriptions are provided to illustrate the inventive concepts to a person of ordinary skill in the art and to enable such person to make and use the inventive concepts.

DEFINITIONS

The following definitions are provided in order to aid those skilled in the art in understanding the detailed description of this disclosure.

The term "cone assembly" as used herein includes various types and shapes of roller-cone assemblies and cutter-cone assemblies rotatably mounted to a support arm. Cone assemblies may also be referred to equivalently as "roller cones," "roller-cone cutters," "roller-cone cutter assemblies," or "cutter cones." Cone assemblies may have a generally conical, tapered (truncated) exterior shape or may have a more rounded exterior shape. Cone assemblies associated with roller-cone drill bits generally point inward toward each other or at least in the direction of the axial center of the drill bit. For some applications, such as roller-cone drill bits having only one cone assembly, the cone assembly may have an exterior shape approaching a generally spherical configuration.

The term "cutting element" as used herein includes various types of compacts, inserts, milled teeth and welded compacts suitable for use with roller-cone drill bits. The terms "cutting structure" and "cutting structures" may equivalently be used in this application to include various combinations and arrangements of cutting elements formed on or attached to one or more cone assemblies of a roller-cone drill bit.

The term "bearing structure," as used herein, includes any suitable bearing, bearing system and/or supporting structure satisfactory for rotatably mounting a cone assembly on a support arm. For example, a "bearing structure" may include inner and outer races and bushing elements to form a journal bearing, a roller bearing (including, but not limited to, a roller-ball-roller-roller bearing, a roller-ball-roller bearing, and a roller-ball-friction bearing) or a wide variety of solid bearings. Additionally, a bearing structure may include interface elements such as bushings, rollers, balls, and areas of hardened materials used for rotatably mounting a cone assembly with a support arm.

The term "spindle" as used in this application includes any suitable journal, shaft, bearing pin, structure or combination of structures suitable for use in rotatably mounting a cone assembly on a support arm. In accordance with the instant disclosure, and without limitation, one or more bearing structures may be disposed between adjacent portions of a cone assembly and a spindle to allow rotation of the cone assembly relative to the spindle and associated support arm.

The term "fluid seal" may be used in this application to include any type of seal, seal ring, backup ring, elastomeric seal, seal assembly or any other component satisfactory for forming a fluid barrier between adjacent portions of a cone assembly and an associated spindle. Examples of fluid seals typically associated with hybrid-type drill bits and suitable for use with the inventive aspects described herein include, but are not limited to, O-rings, packing rings, and metal-to-metal seals.

The term "roller-cone drill bit" may be used in this application to describe any type of drill bit having at least one support arm with a cone assembly rotatably mounted thereon. Roller-cone drill bits may sometimes be described as "rotary-cone drill bits," "cutter-cone drill bits" or "rotary rock bits". Roller-cone drill bits often include a bit body with three support arms extending therefrom and a respective cone assembly rotatably mounted on each support arm. Such drill bits may also be described as "tri-cone drill bits." However, teachings of the present disclosure may be satisfactorily used with drill bits including, but not limited to, hybrid drill bits having one support arm, two support arms or any other number of support arms (a "plurality of" support arms) and associated cone assemblies.

As used herein, the terms "leads," "leading," "trails," and "trailing" are used to describe the relative positions of two structures (e.g., two cutter elements) on the same blade relative to the direction of bit rotation. In particular, a first structure that is disposed ahead or in front of a second structure on the same blade relative to the direction of bit rotation "leads" the second structure (i.e., the first structure is in a "leading" position), whereas the second structure that is disposed behind the first structure on the same blade relative to the direction of bit rotation "trails" the first structure (i.e., the second structure is in a "trailing" position).

As used herein, the terms "axial" and "axially" generally mean along or parallel to the bit axis (e.g., bit axis 15 (see FIG. 1)), while the terms "radial" and "radially" generally mean perpendicular to the bit axis. For instance, an axial distance refers to a distance measured along or parallel to the bit axis, and a radial distance refers to a distance measured perpendicularly from the bit axis.

DETAILED DESCRIPTION

The figures described above and the written description of specific structures and functions below are not presented to limit the scope of what is disclosed herein or the scope of the appended claims. Rather, the figures and written description are provided to teach any person skilled in the art to make and use the disclosures for which patent protection is sought. Those skilled in the art will appreciate that not all features of a commercial embodiment of the disclosures are described or shown for the sake of clarity and understanding. Persons of skill in this art will also appreciate that the development of an actual commercial embodiment incorporating aspects of these disclosures will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of skill in this art having benefit of this disclosure. It must be understood that the disclosures described and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like, are used in the written description for clarity in specific reference to the figures and are not intended to limit the scope of the disclosure or the appended claims.

Disclosed herein is a hybrid earth-boring drill bit having primary and secondary fixed-blade cutters and at least one rolling cutter that is in substantially linear or angular alignment with one of the secondary fixed-blade cutters, the drill bit exhibiting increased drilling efficiency and improved cleaning features while drilling. More particularly, when the drill bit has at least one secondary fixed-blade cutter, or a part thereof (such as a part or all of the PDC cutting structure of the secondary fixed-blade cutter) in substantial alignment (linearly or angularly) with the centerline of the roller-cone cutter and/or the rolling-cone cutter elements, a number of advantages in bit efficiency, operation, and performance are observed. Such improvements include, but are not limited to: more efficient cleaning of cutting structures (e.g., the front and back of the roller-cone cutter, or the cutting face of the fixed-blade cutting elements) by the nozzle arrangement and orientation (tilt) and number of nozzles allowed by this arrangement; better junk slot spacing and arrangement for the cuttings to be efficiently removed from the drill face during a drilling operation; more space available for the inclusion of additional and varied fixed-blade cutters having PDC or other suitable cutting elements; improved capability of the bit for handling larger volumes of cutters (both fixed-blade and roller-cone); and more room for additional drilling fluid nozzles and their arrangement.

In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. Thus, if a first device couples to a second device, that connection may be through a direct connection, or through an indirect connection via other devices and connections.

Figure 2:
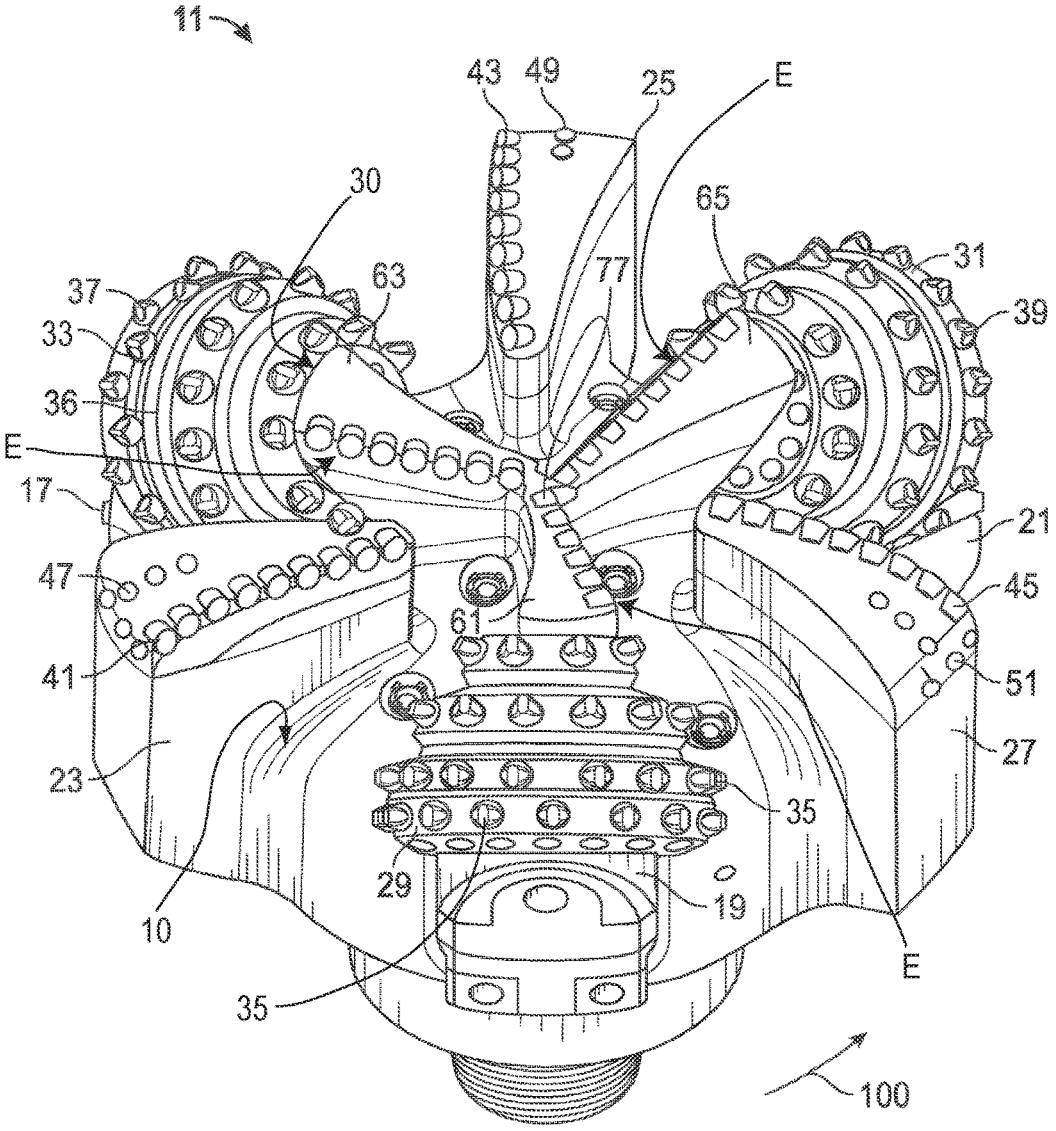
FIG. 2 illustrates a top isometric view of the exemplary drill bit of FIG. 1.
Figure 3:
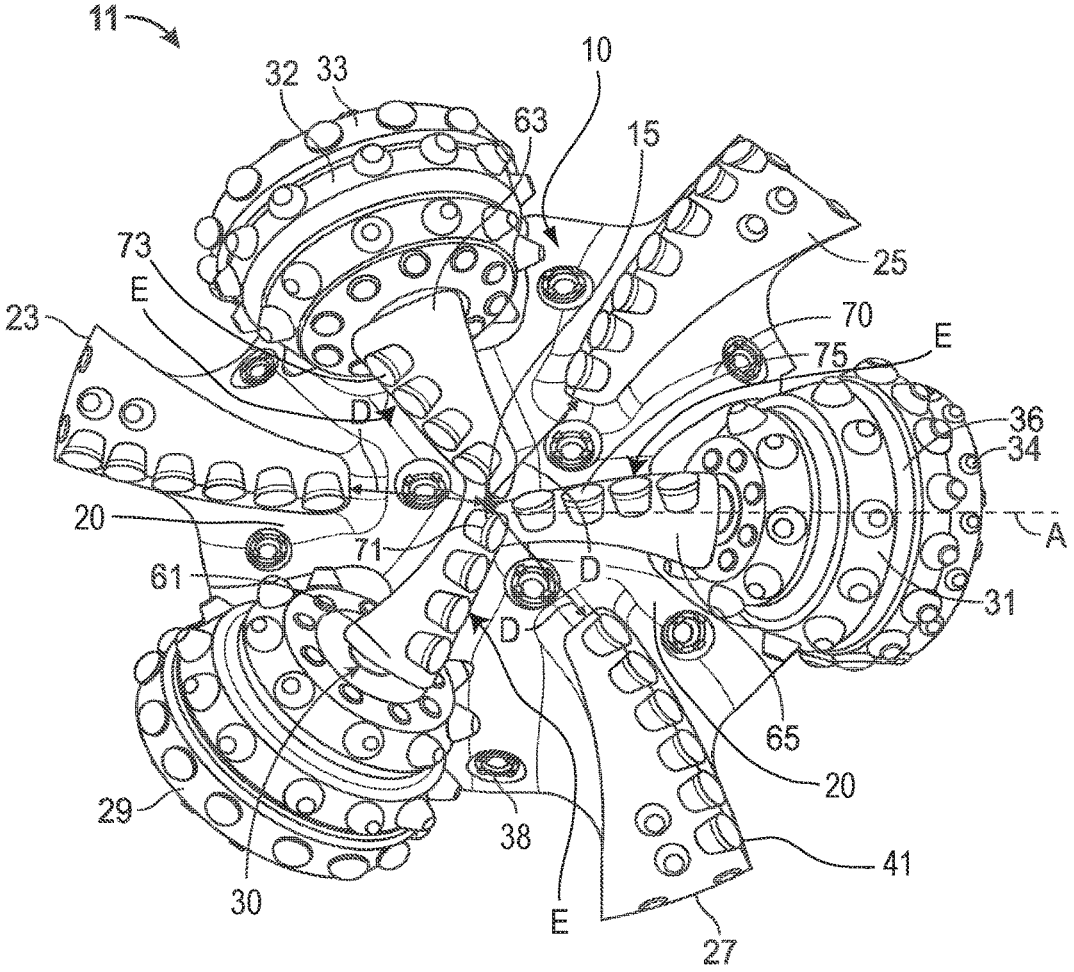
FIG. 3 illustrates a top view of the drill bit of FIG. 1.

Turning now to the figures, FIG. 1 illustrates an isometric, perspective view of an exemplary hybrid drill bit in accordance with the present disclosure. FIG. 2 illustrates a top isometric view of the hybrid drill bit of FIG. 1. FIG. 3 illustrates a top view of the hybrid drill bit of FIG. 1. These figures will be discussed in combination with each other.

As illustrated in FIGS. 1, 2, and 3, hybrid drill bit 11 generally comprises a bit body 13 that is threaded or otherwise configured at its upper end 18 for connection into a drill string. Bit body 13 may be constructed of steel, or of a hard-metal (e.g., tungsten carbide) matrix material with steel inserts. Bit body 13 has an axial center or centerline 15 that coincides with the axis of rotation of hybrid bit 11 in most instances.

Intermediate between an upper end 18 and a longitudinally spaced apart, opposite lower working end 16 is bit body 13. The body 13 of the drill bit 11 also comprises one or more (three are shown) bit legs 17, 19, 21 extending in the axial direction toward lower working end 16 of the bit. Truncated rolling-cone cutter 29, 31, 33 (respectively) are rotatably mounted to each of the bit legs 17, 19, 21, in accordance with methods of the present disclosure as will be detailed herein. Bit body 13 also includes a plurality (e.g., two or more) of primary fixed-blade cutters 23, 25, 27 extending axially downward toward the working end 16 of bit 11. In accordance with aspects of the present disclosure, the bit body 13 also includes a plurality of secondary fixed cutting blades, 61, 63, 65, which extend outwardly from near or proximate to the centerline 15 of the bit 11 toward the apex 30 of the rolling-cone cutter 29, 31, 33, and which will be discussed in more detail herein.

As also shown in FIG. 1, the working end of drill bit 11 is mounted on a drill bit shank 24 that provides a threaded connection 22 at its upper end 18 for connection to a drill string, drill motor or other bottom hole assembly in a manner well known to those in the drilling industry. The drill bit shank 24 also provides a longitudinal passage within the bit (not shown) to allow fluid communication of drilling fluid through jetting passages and through standard jetting nozzles (not shown) to be discharged or jetted against the wellbore and bore face through nozzle ports 38 adjacent the drill bit cutter body 13 during bit operation. Drilling fluid is circulated through these ports in use, to wash and cool the working end 16 of the drill bit 11 and the devices (e.g., the fixed blades and cutter cones), depending upon the orientation of the nozzle ports. A lubricant reservoir (not shown) supplies lubricant to the bearing spaces of each of the cones. The drill bit shank 24 also provides a bit breaker slot 26, a groove formed on opposing lateral sides of the bit shank 24 to provide cooperating surfaces for a bit breaker slot in a manner well known in the industry to permit engagement and disengagement of the drill bit 11 with a drill string assembly. The shank 24 is designed to be coupled to a drill string of tubular material (not shown) with threads 22 according to standards promulgated, for example, by the American Petroleum Institute (API).

Figure 3A:
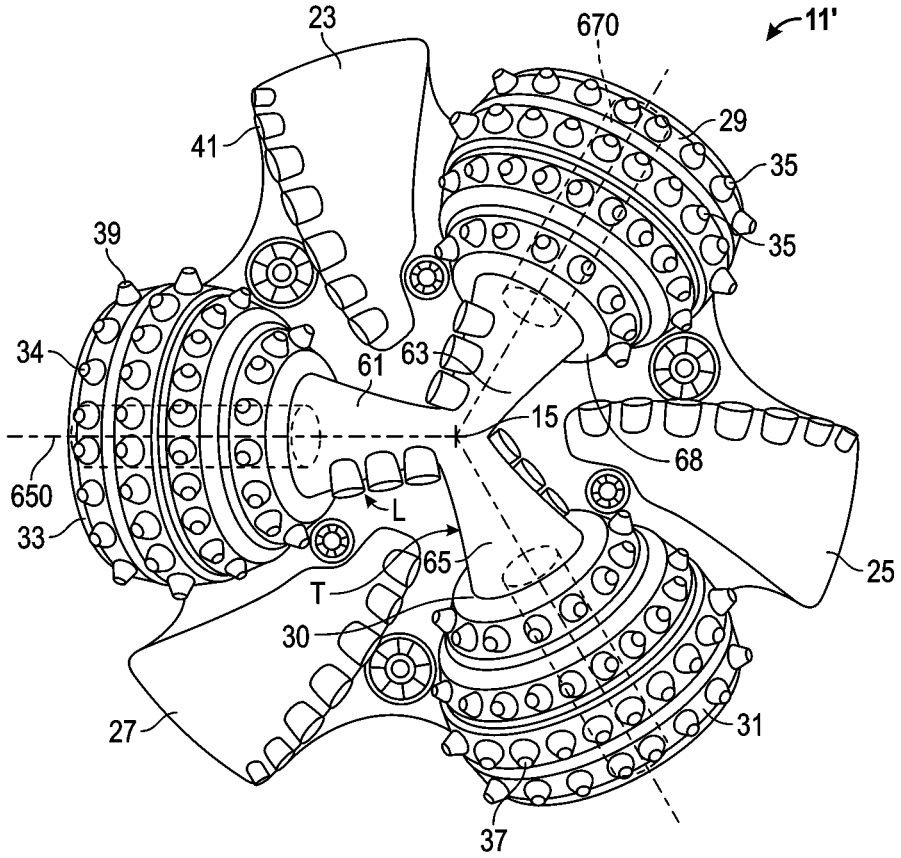
FIG. 3A illustrates a top view of an alternative arrangement of an exemplary drill bit in accordance with embodiments of the present disclosure.

With continued reference to the isometric view of hybrid drill bit 11 in FIG. 1 and FIG. 2, the longitudinal centerline 15 defines an axial center of the hybrid drill bit 11, as indicated previously. As referenced above, drill bit 11 also includes at least one primary fixed cutting blade 23, preferably a plurality of (two or more) primary fixed cutting blades, that extend downwardly from the shank 24 relative to a general orientation of the drill bit 11 inside a borehole, and at least one secondary fixed cutting blade 61, preferably a plurality of (two or more) secondary cutting blades, radiating outward from the axial center of the drill bit 11 toward corresponding cutter cones 29. As shown in the FIG. 1, the fixed blades may optionally include stabilization, or gauge pads 42, which, in turn, may optionally include a plurality of cutting elements 44, typically referred to as gauge cutters. A plurality of primary fixed-blade cutting elements 41, 43, 45 is arranged and secured to a surface on each of the primary fixed cutting blades 23, 25, 27 such as at the leading edges "E" of the blades relative to the direction of rotation (100). Similarly, a plurality of secondary fixed-blade cutting elements 71, 73, 75 (see FIG. 3) is arranged and secured to a surface on each of the secondary fixed cutting blades, such as at the leading edge "E" of the secondary fixed cutting blades 61, 63, 65 (versus at the terminal edge "T" (see FIG. 3A) of either the primary or secondary fixed cutting blades). Generally, the fixed-blade cutting elements 41, 43, 45 (and 61, 63, 65) comprise a polycrystalline diamond compact (PDC) layer or table on a face of a supporting substrate, such as tungsten carbide or the like, the diamond layer or table providing a cutting face having a cutting edge at a periphery thereof for engaging the formation. This combination of PDC and substrate form the PDC-type cutting elements, which are, in turn, attached or bonded to cutters, such as cylindrical and stud-type cutters, and then attached to the external surface of the drill bit 11. Both primary and secondary fixed-blade cutting elements 41, 43, 45 and 61, 63, 65, respectively, may be brazed or otherwise secured by way of suitable attachment means in recesses or "pockets" on each fixed blade 23, 25, 27 and 61,63, 65, respectively, so that their peripheral or cutting edges on cutting faces are presented to the formation. The term PDC is used broadly herein and is meant to include other materials, such as thermally stable polycrystalline diamond (TSP) wafers or tables mounted on tungsten carbide or similar substrates, and other, similar superabrasive or superhard materials including, but not limited to, cubic boron nitride and diamond-like carbon.

A plurality of flat-topped, wear-resistant inserts formed of tungsten carbide or similar hard metal with a polycrystalline diamond cutter attached thereto may be provided on the radially outermost or gage surface of each of the primary fixed-blade cutters 23, 25, 27. These "gage cutters" serve to protect this portion of the drill bit from abrasive wear encountered at the sidewall of the borehole during bit operation. Also, one or more rows, as appropriate, of a plurality of backup cutters 47, 49, 51 may be provided on each fixed-blade cutter 23, 25, 27 between the leading and trailing edges thereof, and arranged in a row that is generally parallel to the leading edge "E" of the fixed-blade cutter. Backup cutters 47, 49, 51 may be aligned with the main or primary fixed-blade cutting elements 41, 43, 45 on their respective primary fixed-blade cutters 23, 25, 27 so that they cut in the same swath, kerf, or groove as the main or primary cutting elements on a fixed-blade cutter. The backup cutters 47, 49, 51 are similar in configuration to the primary fixed-blade cutting elements 41, 43, 45, and may be the same shape as, or smaller in diameter, and further may be more recessed in a fixed-blade cutter to provide a reduced exposure above the blade surface than the exposure of the primary fixed-blade cutting elements 41, 43, 45 on the leading blade edges. Alternatively, they may be radially spaced apart from the main fixed-blade cutting elements so that they cut in the same swath, kerf, or groove or between the same swaths, kerfs, or grooves formed by the main or primary cutting elements on their respective fixed-blade cutters. Additionally, backup cutters 47, 49, 51 provide additional points of contact or engagement between the bit 11 and the formation being drilled, thus enhancing the stability of the hybrid drill bit 11. In some circumstances, depending upon the type of formation being drilled, secondary fixed-blade cutters may also include one or more rows of backup cutting elements. Alternatively, backup cutters suitable for use herein may comprise BRUTE® cutting elements as offered by Baker Hughes, Incorporated, the use and characteristics being described in U.S. Pat. No. 6,408,958. As yet another alternative, rather than being active cutting elements similar to the fixed-blade cutters described herein, backup cutters 47, 49, 51 could be passive elements, such as round or ovoid tungsten carbide or superabrasive elements that have no cutting edge. The use of such passive elements as backup cutters in the embodiments of the present disclosure would serve to protect the lower surface of each fixed cutting blade from premature wear.

On at least one of the secondary fixed-blade cutters 61, 63, 65, a cutting element 77 is located at or near the central axis or centerline 15 of bit body 13 ("at or near" meaning some part of the fixed cutter is at or within about 0.040 inch of the centerline 15). In the illustrated embodiment, the radially innermost cutting element 77 in the row on fixed-blade cutter 61 has its circumference tangential to the axial center or centerline 15 of the bit body 13 and hybrid drill bit 11.

As referenced above, the hybrid drill bit 11 further preferably includes at least one, and preferably at least two (although more may be used, equivalently and as appropriate) rolling cutter legs 17, 19, 21 and rolling-cone cutters 29, 31, 33 coupled to such legs at the distal end (the end toward the working end 16 of the drill bit 11) of the rolling cutter legs 17, 19, 21. The rolling cutter legs 17, 19, 21 extend downwardly from the shank 24 relative to a general orientation of the drill bit 11 inside a borehole. As is understood in the art, each of the rolling cutter legs 17, 19, 21 includes a spindle or similar assembly therein having an axis of rotation about which the rolling cutter rotates during operation. This axis of rotation is generally disposed as a pin angle ranging from about 33 degrees to about 39 degrees from a horizontal plane perpendicular to the centerline 15 of the drill bit 11. In at least one embodiment of the present disclosure, the axis of rotation of one (or more, including all) rolling cutter intersects the longitudinal centerline 15 of the drill bit 11. In other embodiments, the axis of rotation of one or more rolling cutters about a spindle or similar assembly can be skewed to the side of the longitudinal centerline to create a sliding effect on the cutting elements as the rolling cutter rotates around the axis of rotation. However, other angles and orientations can be used including a pin angle pointing away from the longitudinal, axial centerline 15.

With continued reference to FIGS. 1, 2 and 3, rolling-cone cutters 29, 31, 33 are mounted for rotation (typically on a journal bearing, but rolling elements or other bearings may be used as well) on each bit leg 17, 19, 21, respectively. Each rolling-cone cutter 29, 31, 33 has a plurality of cutting elements 35, 37, 39 arranged on the exterior face of the rolling-cone cutter body 29, 31, 33. In the illustrated non-limiting embodiment of FIGS. 1, 2, and 3, the cutting elements 35, 37, 39 are arranged in generally circumferential rows about the rolling-cone cutters 29, 31, 33, and are tungsten carbide inserts (or the equivalent), each insert having an interference fit into bores or apertures formed in each rolling-cone cutter 29, 31, 33, such as by brazing or similar approaches. Alternatively, and equally acceptable, the rows of cutting elements 35, 37, 39 on one or more of the rolling-cone cutters 29, 31, 33 may be arranged in a non-circumferential row or spiral cutting arrangement around the exterior face of the rolling-cone cutter 29, 31, 33, rather than in spaced linear rows as shown in the figures. Alternatively, cutting elements 35, 37, 39 can be integrally formed with the cutter and hardfaced, as in the case of steel- or milled-tooth cutters. Materials other than tungsten carbide, such as polycrystalline diamond or other superhard or superabrasive materials, can also be used for rolling-cone cutter cutting elements 35, 37, 39 on rolling-cone cutters 29, 31, 33.

The rolling-cone cutters 29, 30, 31, in addition to a plurality of cutting elements 35, 37, 39 attached to or engaged in an exterior surface 32 of the rolling-cone cutter body, may optionally also include one or more grooves 36 formed therein to assist in cone efficiency during operation. In accordance with aspects of the present disclosure, while the cone-cutting elements 35, 37, 39 may be randomly placed, specifically, or both (e.g., varying between rows and/or between rolling-cone cutters 29, 31, 33) spaced about the exterior surface 32 of the cutters 29, 31, 33. In accordance with at least one aspect of the present disclosure, at least some of the cutting elements 35, 37, 39 are generally arranged on the exterior surface 32 of a rolling-cone cutter 29, 31, 33 in a circumferential row thereabout, while others, such as cutting elements 34 on the heel region of the rolling-cone cutter 29, 31, 33, may be randomly placed. A minimal distance between the cutting elements will vary according to the specific drilling application and formation type, cutting element size, and bit size, and may vary from rolling-cone cutter to rolling-cone cutter, and/or cutting element to cutting element. The cutting elements 35, 37, 39 can include, but are not limited to, tungsten carbide inserts, secured by interference fit into bores in the surface of the rolling cutter, milled- or steel-tooth cutting elements integrally formed with and protruding outwardly from the external surface 32 of the rolling cutter and which may be hardfaced or not, and other types of cutting elements. The cutting elements 35, 37, 39 may also be formed of, or coated with, superabrasive or superhard materials such as polycrystalline diamond, cubic boron nitride, and the like. The cutting elements may be generally chisel-shaped as shown, conical, round/hemispherical, ovoid, or other shapes and combinations of shapes depending upon the particular drilling application. The cutting elements 35, 37, 39 of the rolling-cone cutters 29, 31, 33 crush and pre- or partially fracture subterranean materials in a formation in the highly stressed leading portions during drilling operations, thereby easing the burden on the cutting elements of both the primary and secondary fixed cutting blades 41, 43, 45, and 61, 63, 65, respectively.

In the embodiments of the disclosures illustrated in FIGS. 1, 2 and 3, rolling-cone cutters 29, 31, 33 are illustrated in a non-limiting arrangement to be angularly spaced approximately 120 degrees apart from each other (measured between their axes of rotation). The axis of rotation of each rolling-cone cutter 29, 31, 33 intersecting the axial center 15 of bit body 13 of hybrid bit 11, although each or all of the rolling-cone cutters 29, 31, 33 may be angularly skewed by any desired amount and (or) laterally offset so that their individual axes do not intersect the axial center of bit body 13 or hybrid drill bit 11. By way of illustration only, a first rolling-cone cutter 29 may be spaced apart approximately 58 degrees from a first primary fixed blade 23 (measured between the axis of rotation of rolling-cone cutter 29 and the centerline of fixed cutting blade 23 in a clockwise manner in FIG. 3) forming a pair of cutters. A second rolling-cone cutter 31 may be spaced approximately 63 degrees from a second primary fixed cutting blade 25 (measured similarly) forming a pair of cutters; and, a third rolling-cone cutter 33 may be spaced approximately 53 degrees apart from a third primary fixed cutting blade 27 (again measured the same way) forming a pair of cutters.

The rolling-cone cutters 29, 31, 33 are typically coupled to a generally central spindle or similar bearing assembly within the cone cutter body, and are, in general, angular or linear alignment with the corresponding secondary fixed cutting blades 61, 63, 65, as will be described in more detail below. That is, each of the respective secondary fixed cutting blades 61, 63, 65, extends radially outward from substantially proximal the axial centerline 15 of the drill bit 11 toward the periphery, and terminates proximate (but not touching, a space or void 90 (see FIG. 4) existing between the terminal end of the secondary fixed cutting blade 61, 63, 65 and the apex of the cone cutter) to the apex, or top end 30, of the respective rolling-cone cutters 29, 31 33, such that a line drawn from and perpendicular to the centerline 15 would pass through substantially the center of each secondary fixed cutting blade 61, 63, 65 and substantially the center of each rolling-cone cutter 29, 31, 33 aligned with a respective secondary fixed cutting blade 61, 63, 65. The truncated, or frustoconical, rolling-cone cutters 29, 30, 31 shown in the figures, and as seen most clearly in FIG. 3, generally have a top end 30 extending generally toward the axial centerline 15, and that in some embodiments can be truncated compared to a typical roller-cone bit. The rolling cutter, regardless of shape, is adapted to rotate around an inner spindle or bearing assembly when the hybrid drill bit 11 is being rotated by the drill string through the shank 24. Additionally, and in relation to the use of a saddle-pin design such as described and shown in FIG. 3A (referencing drill bit 11'), and the embodiments described in association with FIGS. 12 and 14-16, when a central bearing pin or spindle 670 is used to connect a secondary fixed cutting blade to a rolling-cone cutter, the bearing pin or spindle extending along the roller cone axis 650, the terminal end 68 (see FIG. 3A) of the secondary fixed cutting blade (e.g., 61, 63, or 65 in FIG. 3A) proximate to the apex or top end 30 of the respective rolling-cone cutter (29, 31, 33) to which it is aligned may optionally be widened to have a diameter (measured between the leading "L" and terminal "T" edges) that is substantially the same as the diameter of the top end 30 of the truncated rolling-cone cutter. Such an arrangement allows for the optional addition of further rows of cutting elements on the rolling-cone cutter, and the widened connection point acts to reduce balling of cuttings during bit operation and minimize or eliminate 'ring out' in a potential problem area.

Figure 4:
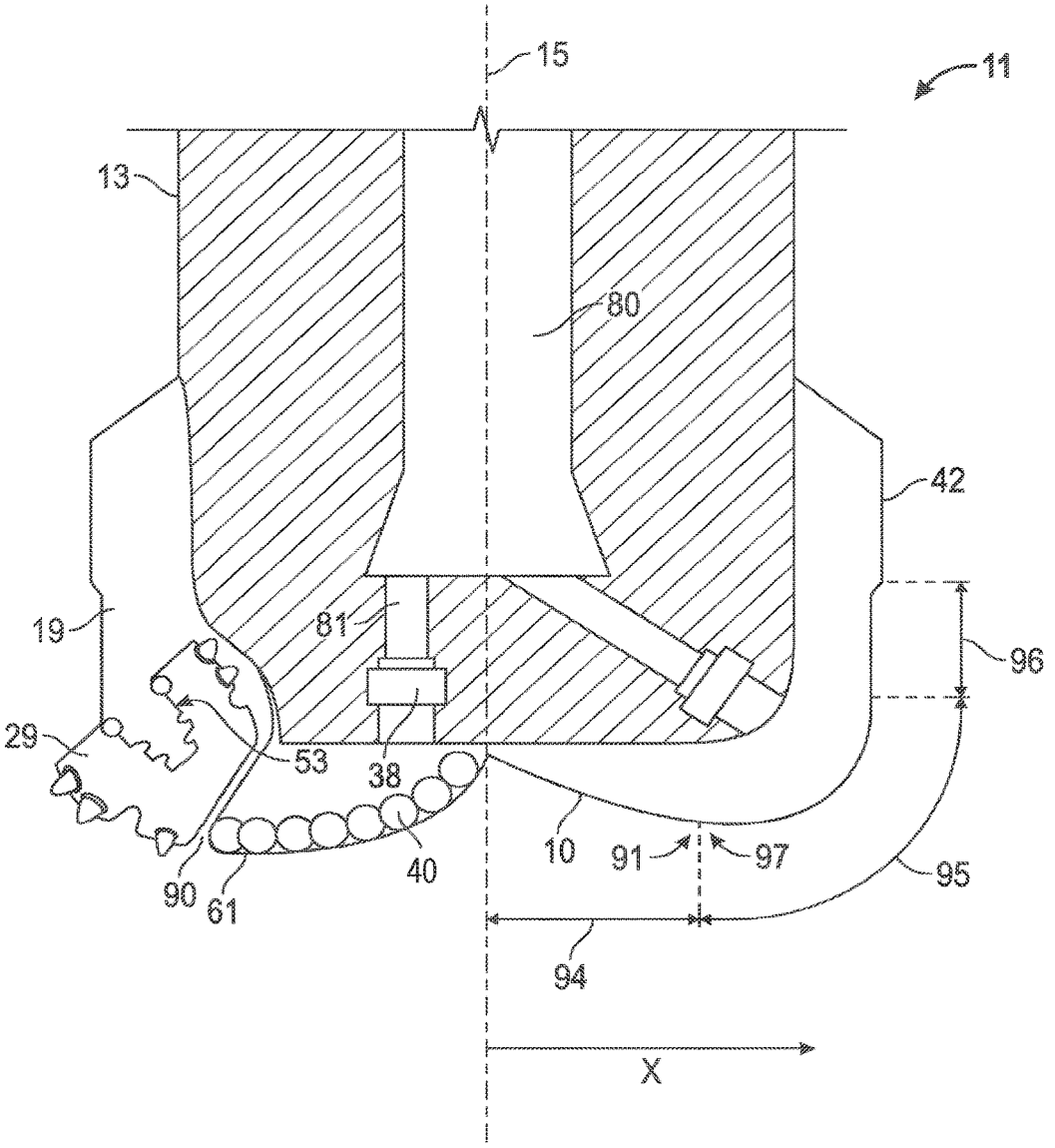
FIG. 4 illustrates a partial cross-sectional view of the drill bit of FIG. 1, with the cutter elements of the bit shown rotated into a single cutter profile.

As best seen in the cross-sectional view of FIG. 4, bit body 13 typically includes a central longitudinal bore 80 permitting drilling fluid to flow from the drill string into drill bit 11. Bit body 13 is also provided with downwardly extending flow passages 81 having ports or nozzles 38 disposed at their lowermost ends. The flow passages 81 are preferably in fluid communication with central bore 80. Together, flow passages 81 and nozzles 38 serve to distribute drilling fluids around a cutting structure via one or more recesses and/or junk slots 70, such as toward one of the roller cones or the leading edge of a fixed-blade and/or associated cutter, acting to flush away formation cuttings during drilling and to remove heat from drill bit 11. Junk slots 70 provide a generally unobstructed area or volume for clearance of cuttings and drilling fluid from the central portion of the drill bit 11 to its periphery for return of those materials to the surface. As shown in, for example, FIG. 3, junk slots 70 are defined between the bit body 13 and the space between the trailing side or edge "T" of a fixed-blade cutter and the leading edge "L" of a separate fixed-blade cutter.

Referring again to FIGS. 1, 2 and 3, the working end 16 of exemplary drill bit 11 includes a plurality of fixed cutting blades which extend outwardly from the face of drill bit 11. In the embodiment illustrated in FIGS. 1, 2 and 3, the drill bit 11 includes three primary fixed cutting blades 23, 25, 27 circumferentially spaced apart about bit axis 15, and three secondary fixed cutting blades 61, 63, 65 circumferentially spaced apart about and radiating outward from bit axis 15 toward the respective rolling-cone cutters 29, 31, 33, at least one of the fixed cutting blades being in angular alignment with at least one of the rolling-cone cutters. In this illustrated embodiment, the plurality of fixed cutting blades (e.g., primary fixed cutting blades 23, 25, 27 and secondary fixed cutting blades 61, 63, 65) are generally uniformly angularly spaced on the bit face of the drill bit 11, about central longitudinal bit axis 15. In particular, each primary fixed cutting blade 23, 25, 27 is generally being spaced an amount ranging from about 50 degrees to about 180 degrees, inclusive from its adjacent primary fixed cutting blade. For example, in the embodiment illustrated generally in FIGS. 11 and 12, the two primary cutting blades 623, 625 are spaced substantially opposite each other (e.g., about 180 degrees apart). In other embodiments (not specifically illustrated), the fixed blades may be spaced non-uniformly about the bit face. Moreover, although exemplary hybrid drill bit 11 is shown as having three primary fixed cutting blades 23, 25, 27 and three secondary fixed blades 61, 63, 65, in general, drill bit 11 may comprise any suitable number of primary and secondary fixed blades.

Figure 6:
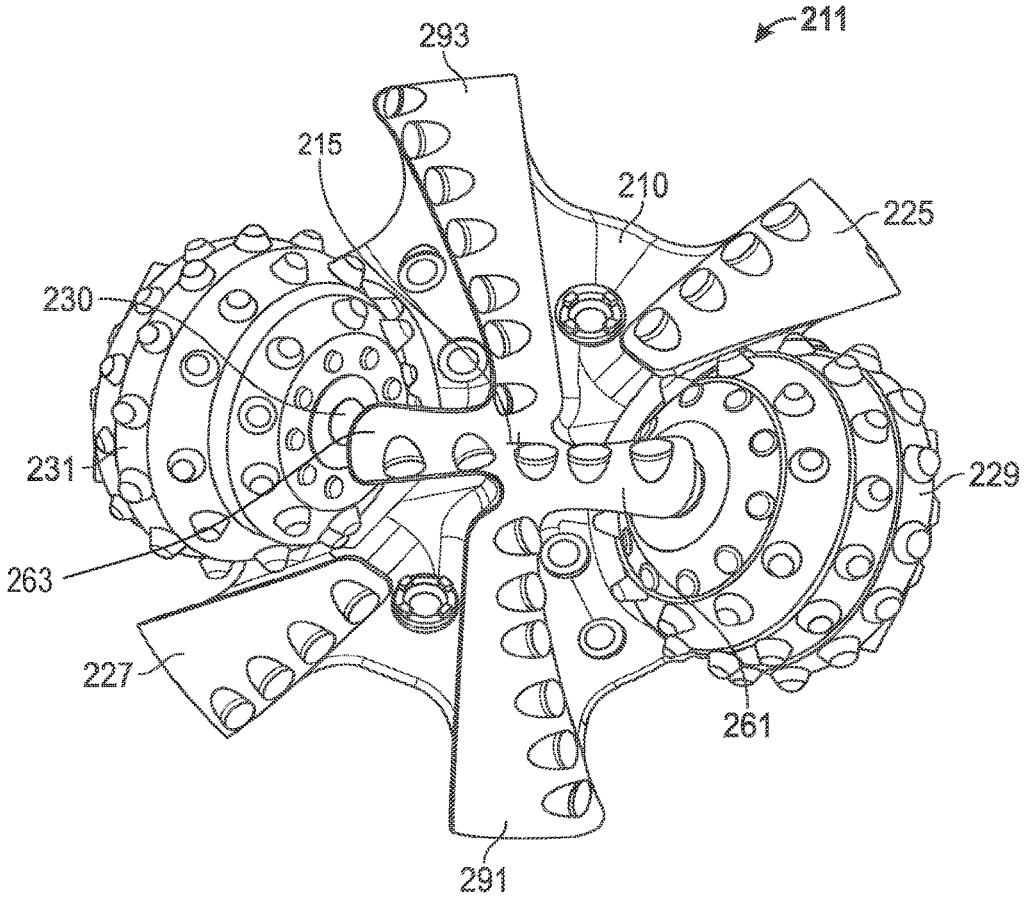
FIG. 6 illustrates a top view of a drill bit in accordance with further aspects of this disclosure.

As one non-limiting example, and as illustrated generally in FIG. 6, drill bit 211 may comprise two primary fixed blades 225, 227, two secondary fixed blades 261, 263 extending from the axial centerline 215 of the bit 211 toward the apex 230 of two rolling-cone cutters 229, 231 that are spaced substantially opposite each other (e.g., approximately 180 degrees apart). As is further shown in FIG. 6, drill bit 211 includes two tertiary blades 291, 293 that may or may not be formed as part of the secondary fixed cutters 261, 263, and that extend radially outward from substantially proximal the axial centerline 215 of the drill bit 211 toward the periphery of the bit 211.

Figure 7:
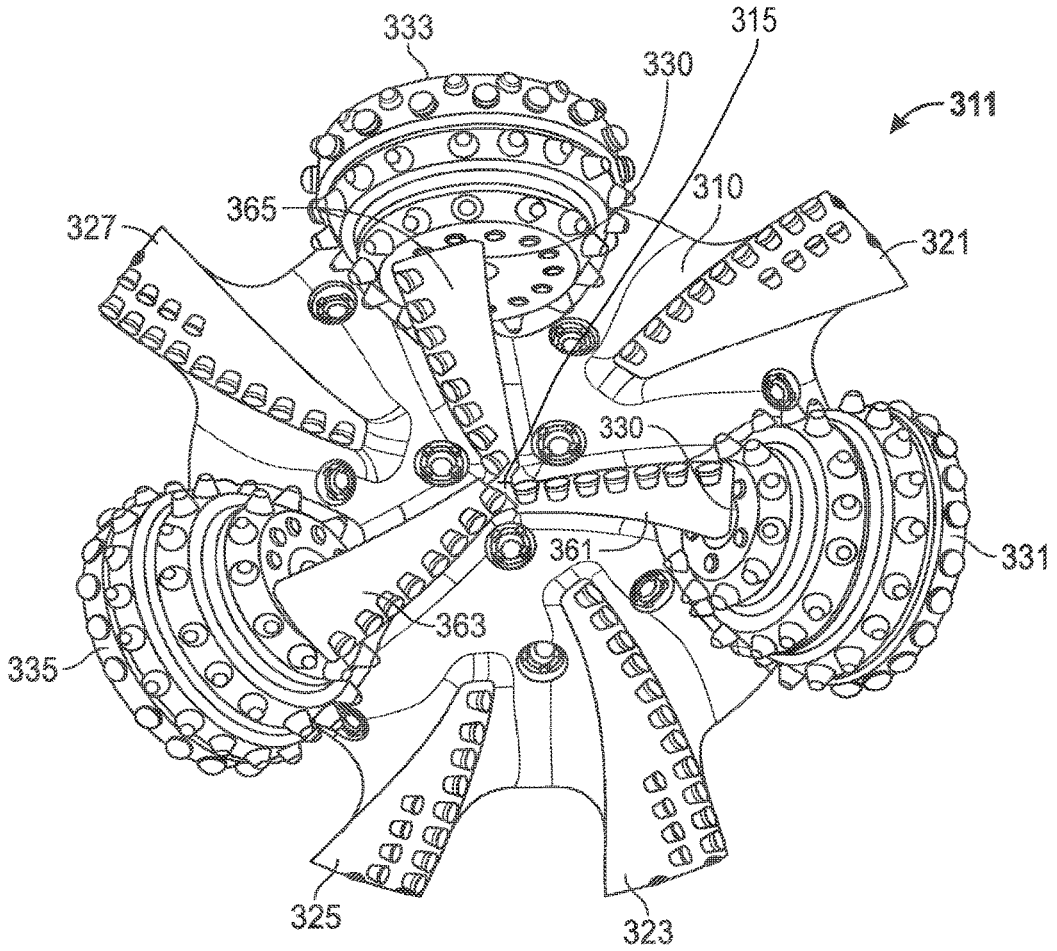
FIG. 7 illustrates a top view of a drill bit in accordance with additional aspects of this disclosure.
Figure 8:
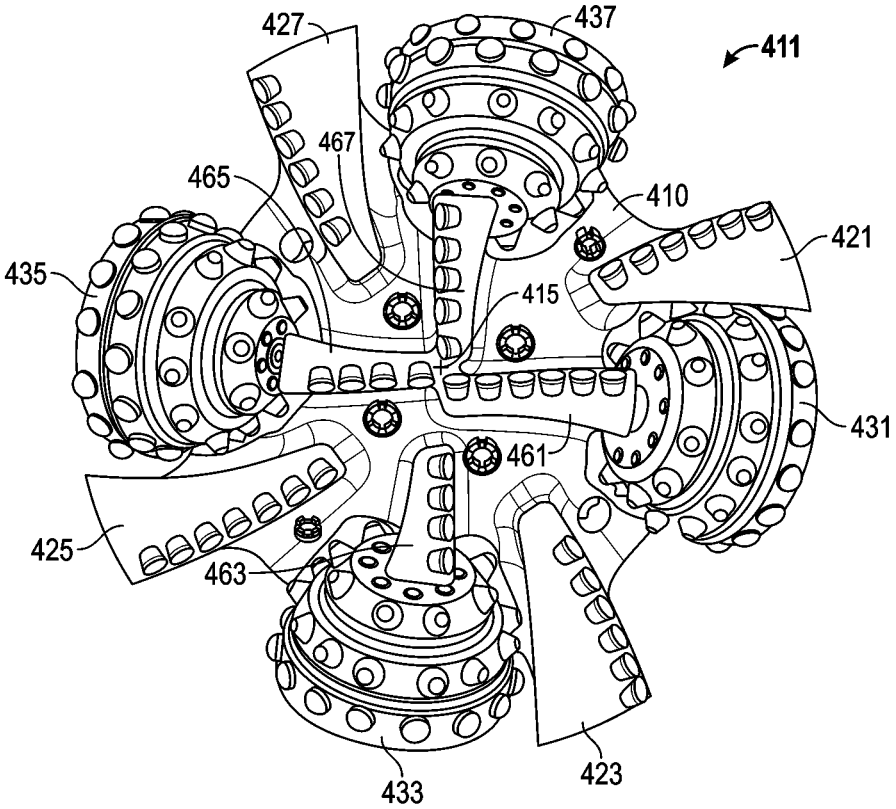
FIG. 8 illustrates a top view of a drill bit in accordance with a further aspect of this disclosure.

Another non-limiting example arrangement of cutting elements on a drill bit in accordance with the present disclosure is illustrated generally in FIG. 7. As shown therein, drill bit 311 includes three rolling-cone cutters 331, 333, 335 at the outer periphery of the bit 311 and directed inward toward the axial centerline 315 of bit 311. The drill bit 311 further includes three secondary fixed blades 361, 363, 365 extending from the axial centerline 315 of the bit 311 toward the apex 330 of the three rolling-cone cutters 331, 333, 335. Also shown are four primary fixed-blade cutters 321, 323, 325, 327 extending from the periphery of the drill bit 311 toward, but not into, the cone region or near the center axis 315 of the bit. As is further shown in the alternative arrangement of FIG. 7, the three rolling-cone cutters 331, 333, 335 are oriented such that rolling-cone cutters 331 and 333 and rolling-cone cutters 333 and 335 are spaced approximately equal distance apart from each other, e.g., about 85-110 degrees (inclusive). Rolling-cone cutters 335 and 331 are spaced approximately 100-175 degrees apart, allowing for the inclusion of an additional primary fixed cutting blade 325 to be included in the space between rolling-cone cutters 335 and 331 and adjacent to primary fixed cutting blade 323. In a further, non-limiting example, as shown in FIG. 8, a drill bit 411 in accordance with the present disclosure may include four rolling-cone cutters 431, 433, 435, 437, four primary fixed cutting blades 421, 423, 425, 427, and four secondary fixed cutting blades 461, 463, 465, 467. As with other embodiments of the present disclosure, the secondary fixed cutting blades 461, 463, 465, 467 extend radially outward from substantially proximal the axial centerline 415 of the drill bit 411, in substantial linear alignment with each respective rolling-cone cutter 431, 433, 435, 437.

With continued reference to FIGS. 1, 2 and 3, primary fixed cutting blades 23, 25, 27 and secondary fixed cutting blades 61, 63, 65 are integrally formed as part of, and extend from, bit body 13 and bit face 10. Primary fixed cutting blades 23, 25, 27, unlike secondary fixed cutting blades 61, 63, 65, extend radially across bit face 10 from the region on the bit face 10 outward toward the outer periphery of the drill bit 11 and, optionally, longitudinally along a portion of the periphery of drill bit 11. As will be discussed in more detail herein, primary fixed cutting blades 23, 25, 27 can extend radially from a variety of locations on the bit face 10 toward the periphery of drill bit 11, ranging from substantially proximal the central axis 15 to the nose region outward, to the shoulder region outward, and to the gage region outward, and combinations thereof. However, secondary fixed cutting blades 61, 63, 65, while extending from substantially proximal central axis 15, do not extend to the periphery of the drill bit 11. Rather, and as best seen in the top view in FIG. 3 showing an exemplary, non-limiting spatial relationship of the rolling cutters to the primary and secondary fixed cutting blades and the rolling-cone cutters (and their respective cutting elements mounted thereon), primary fixed cutting blades 23, 25, 27 extend radially from a location that is a distance "D" away from central axis 15 toward the periphery of drill bit 11. The distances "D" may be substantially the same between respective primary fixed cutting blades, or may be un-equivalent, such that the distance "D" between a first primary fixed cutting blade is longer or shorter than the distance "D" between a second (and/or third) primary fixed cutting blade. Thus, as used herein, the term "primary fixed cutting blade" refers to a blade that begins at some distance from the bit axis and extends generally radially along the bit face to the periphery of the bit. Regarding the secondary fixed cutting blades 61, 63, 65, as compared to the primary fixed cutting blades 23, 25, 27, the secondary fixed cutting blades 61, 63, 65 extend substantially more proximate to central axis 15 than primary fixed cutting blades 23, 25, 27, and extend outward in a manner that is in substantially angular alignment with the top end 30 of the respective rolling-cone cutters 29, 31, 33. Thus, as used herein, the term "secondary fixed cutting blade" refers to a blade that begins proximal the bit central axis 15 or within the central face of the drill bit 11 and extends generally radially outward along the bit face 10 toward the periphery of the drill bit 11 in general angular alignment with a corresponding, proximal rolling-cone cutter. Stated another way, secondary fixed cutting blades 61, 63, 65 are arranged such that they extend from their proximal end (near the axial centerline 15 of the drill bit 11) outwardly toward the end or top face 30 of the respective rolling cutters, in a general axial or angular alignment, such that the distal end (the outermost end of the secondary fixed cutting blade, extending toward the outer or gage surface of the bit body 13) of the secondary fixed cutting blades 61, 63, 65 are proximate and, in some instances, joined with the end face 30 of the respective roller cutters to which they approach. As further shown in FIG. 3, primary fixed cutting blades 23, 25, 27 and secondary fixed cutting blades 61, 63, 65, as well as rolling-cone cutters 29, 31, 33, may be separated by one or more drilling fluid flow courses 20. The angular alignment line "A" between a secondary fixed blade and a rolling cone may be substantially aligned with the axial, rotational centerline of the rolling cone or, alternatively and equally acceptable, may be oriented as shown in FIG. 3, wherein the roller-cone and the secondary fixed-blade cutters 61, 63, 65 are slightly offset (e.g., within about 10 degrees) from the axial centerline of the rolling cone.

As described above, the embodiment of drill bit 11 illustrated in FIGS. 1, 2 and 3 includes only three relatively longer (compared to the length of the secondary fixed cutting blades 61, 63, 65) primary fixed cutting blades (e.g., primary fixed cutting blades 23, 25, 27). As compared to some conventional fixed-cutter bits that employ three, four, or more relatively long primary fixed-cutter blades, drill bit 11 has fewer primary blades. However, by varying (e.g., reducing or increasing) the number of relatively long primary fixed cutting blades, certain of the embodiments of this disclosure may improve the rate of penetration (ROP) of drill bit 11 by reducing the contact surface area, and associated friction, of the primary fixed-cutter blades 23, 25, 27. Table 1 below illustrates exemplary, non-limiting possible configurations for drill bits in accordance with the present disclosure when the fixed-blade cutter and the roller-cone cutter are in substantial alignment.

TABLE 1

Possible Configurations for aligned fixed-blade cutters and roller-cone cutters and/or their respective cutting elements.

| | | Fixed-blade cutter - Cutter Location | | | | |
|---|---|---|---|---|---|---|
| At Least One | | FC Center[3] | FC Cone | FC Nose | FC Shoulder | FC Gage |
| Roller-Cone - Cutter Location | RC Center | N.A.[1] | N.A. | N.A. | N.A. | N.A. |
| | RC Cone | Preferred | 1 but not both | Optional[2] | Optional | Optional |

TABLE 1-continued

Possible Configurations for aligned fixed-blade cutters and roller-cone cutters and/or their respective cutting elements.

| At Least One | | Fixed-blade cutter - Cutter Location | | | | |
|---|---|---|---|---|---|---|
| | | FC Center[3] | FC Cone | FC Nose | FC Shoulder | FC Gage |
| | RC Nose | Preferred | Optional | 1 but not both | Optional | Optional |
| | RC Shoulder | Preferred | Optional | Optional | 1 but not both | Optional |
| | RC Gage | Preferred | Optional | Optional | Optional | Optional |

Figure 5:
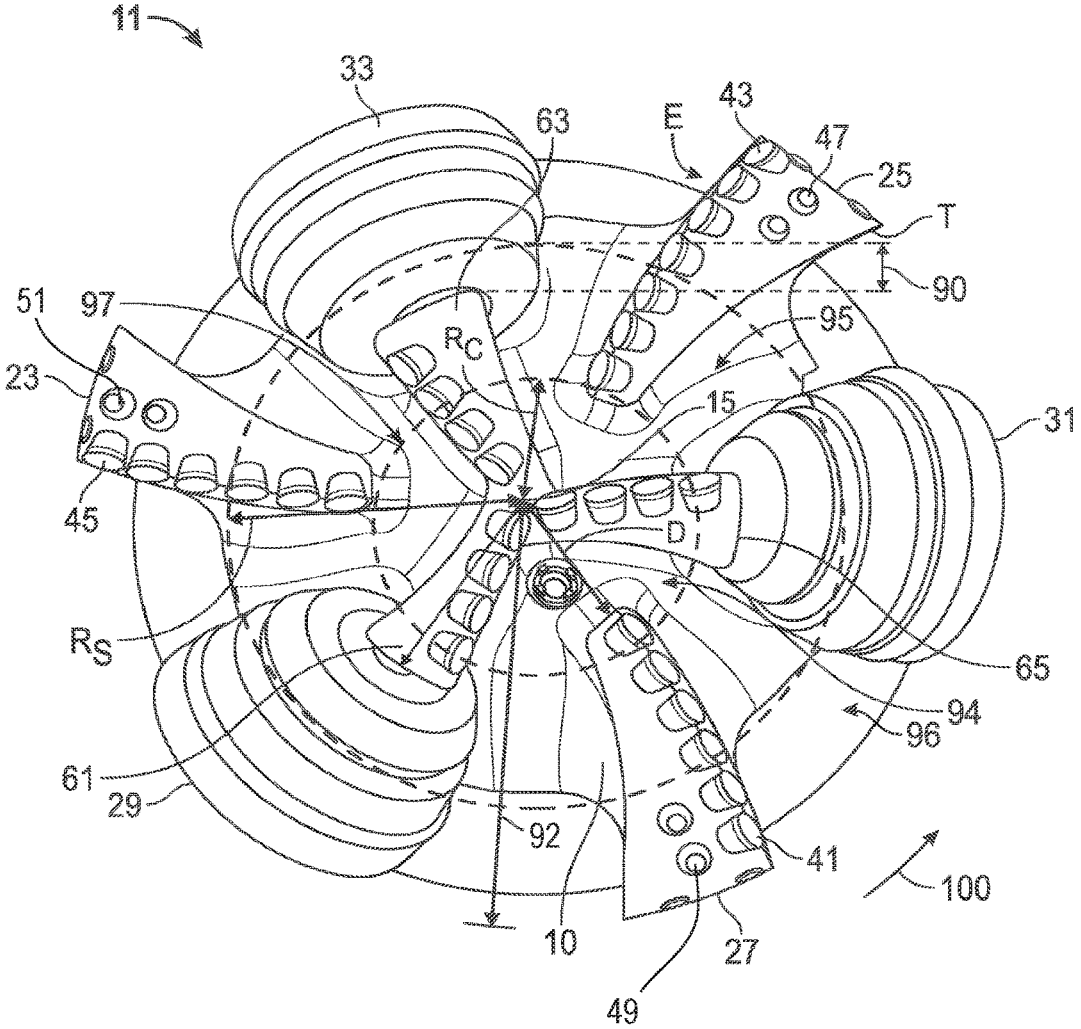
FIG. 5 illustrates a schematic top view of the drill bit of FIG. 1.

*The terms "center," "cone," "nose," "shoulder," and "gage" are as defined with reference to FIGS. 4 and 5 herein.
[1]"N.A." means that the combination would not result in a hybrid-type drill bit.
[2]"Optional" means that this combination will work and is acceptable, but it is neither a required nor a preferred configuration.
[3]"Center" means that cutting elements are located at or near the central axis of the drill bit.

It is not necessary that the fixed-blade cutter and the roller-cone cutter be in, or substantially in, alignment for a drill bit of the present disclosure to be an effective hybrid drill bit (a drill bit having at least one fixed-blade cutter extending downwardly in the axial direction from the face of the bit, and at least one roller-cone cutter). Table 2 below illustrates several exemplary, non-limiting possible configurations for drill bits in accordance with the present disclosure when the fixed-blade cutter and the associated roller-cone cutter are not in alignment ("non-aligned").

TABLE 2

Possible Configurations for non-aligned fixed-blade cutters and roller-cone cutters and/or their respective cutting elements.

| At Least One | | Fixed-blade cutter - Cutter Location | | | | |
|---|---|---|---|---|---|---|
| | | FC Center[3] | FC Cone | FC Nose | FC Shoulder | FC Gage |
| Roller-Cone - Cutter Location | RC Center | N.A.[1] | N.A. | N.A. | N.A. | N.A. |
| | RC Cone | Preferred | Optional[2] | Optional | Optional | Optional |
| | RC Nose | Preferred | Optional | Optional | Optional | Optional |
| | RC Shoulder | Preferred | Optional | Optional | Optional | Optional |
| | RC Gage | Preferred | Optional | Optional | Optional | Optional |

*The terms "center," "cone," "nose," "shoulder," and "gage" are as defined with reference to FIGS. 4 and 5 herein.
[1]"N.A." means that the combination would not result in a hybrid-type drill bit.
[2]"Optional" means that this combination will work and is acceptable, but it is neither a required nor a preferred configuration.
[3]"Center" means that cutting elements are located at or near the central axis of the drill bit.

In view of these tables, numerous secondary fixed-blade cutter and roller-cone cutter arrangements are possible and thus allow a number of hybrid drill bits to be manufactured that exhibit the improved drilling characteristics and efficiencies as described herein.

Referring again to FIG. 4, an exemplary cross-sectional profile of drill bit 11 is shown as it would appear if sliced along line 4-4 of FIG. 1 to show a single rotated profile. For purposes of clarity, all of the fixed cutting blades and their associated cutting elements are not shown in the cross-sectional view of FIG. 4.

In the cross-sectional profile, the plurality of blades of drill bit 11 (e.g., primary fixed blades 23, 25, 27 and secondary fixed blades 61, 63, 65) include blade profiles 91. Blade profiles 91 and bit face 10 may be divided into three different regions labeled cone region 94, shoulder region 95, and gage region 96. Cone region 94 is concave in this embodiment and comprises the innermost region of drill bit 11 (e.g., cone region 94 is the central-most region of drill bit 11). Adjacent cone region 94 is shoulder (or the upturned curve) region 95. In this embodiment, shoulder region 95 is generally convex. The transition between cone region 94 and shoulder region 95, typically referred to as the nose or nose region 97, occurs at the axially outermost portion of composite blade profile 91 where a tangent line to the blade profile 91 has a slope of zero. Moving radially outward, adjacent shoulder region 95 is gage region 96, which extends substantially parallel to bit axis 15 at the radially outer periphery of composite blade profile 91. As shown in composite blade profile 91, gage pads 42 define the outer radius 92 (see FIG. 5) of drill bit 11. In this embodiment, outer radius 92 extends to and, therefore, defines the full gage diameter of drill bit 11. As used herein, the term "full gage diameter" refers to the outer diameter of the bit defined by the radially outermost reaches of the cutter elements and surfaces of the bit.

Still referring to FIG. 4, cone region 94 is defined by a radial distance along the "x-axis" (X) measured from central axis 15. It is to be understood that the x-axis is perpendicular to central axis 15 and extends radially outward from central axis 15. Cone region 94 may be defined by a percentage of outer radius 93 of drill bit 11. In some embodiments, cone region 94 extends from central axis 15 to no more than 50% of outer radius 92. In select embodiments, cone region 94 extends from central axis 15 to no more than 30% of outer radius 92. Cone region 94 may likewise be defined by the location of one or more primary fixed cutting blades (e.g., primary fixed cutting blades 23, 25, 27). For example, cone region 94 extends from central axis 15 to a distance at which a primary fixed cutting blade begins (e.g., distance "D" illustrated in FIG. 3). In other words, the outer boundary of cone region 94 may coincide with the distance "D" at which one or more primary fixed cutting blades begin. The actual radius of cone region 94, measured from central axis 15, may vary from bit to bit depending on a variety of factors including, without limitation, bit geometry, bit type, location of one or more secondary fixed cutting blades (e.g., secondary fixed cutting blades 61, 63, 65), location of backup cutters 47, 49, 51, or combinations thereof. For instance, in some cases, drill bit 11 may have a relatively flat parabolic profile resulting in a cone region 94 that is relatively large (e.g., 50% of outer radius 92). However, in other cases, drill bit 11 may have a relatively long parabolic profile resulting in a relatively smaller cone region 94 (e.g., 30% of outer radius 92).

Referring now to FIG. 5, a schematic top view of drill bit 11 is illustrated. For purposes of clarity, nozzles 38 and other features on bit face 10 are not shown in this view. Moving radially outward from bit axis 15, bit face 10 includes cone region 94, shoulder region 95, and gage region 96 as previously described. Nose region 97 generally represents the transition between cone region 94 and shoulder region 95. Specifically, cone region 94 extends radially from bit axis 15 to a cone radius $R_c$, shoulder region 95 extends radially from cone radius $R_c$ to shoulder radius $R_s$, and gage region 96 extends radially from shoulder radius $R_s$ to bit outer radius 92.

Secondary fixed cutting blades 61, 63, 65 extend radially along bit face 10 from within cone region 94 proximal bit axis 15 toward gage region 96 and outer radius 92, extending approximately to the nose region 97, proximate the top face 30 of roller-cone cutters 29, 31, 33. Primary fixed cutting blades 23, 25, 27 extend radially along bit face 10 from proximal nose region 97, or from another location (e.g., from within the cone region 94) that is not proximal bit axis 15, toward gage region 96 and outer radius 92. In this embodiment, two of the primary fixed cutting blades 23 and 25, begin at a distance "D" that substantially coincides with the outer radius of cone region 94 (e.g., the intersection of cone region 94 and should region 95). The remaining primary fixed cutting blade 27, while acceptable to be arranged substantially equivalent to blades 23 and 25, need not be, as shown. In particular, primary fixed cutting blade 27 extends from a location within cone region 94, but a distance away from the axial centerline 15 of the drill bit 11, toward gage region 96 and the outer radius. Thus, primary fixed cutting blades 23, 25, 27 can extend inward toward bit axial centerline 15 up to or into cone region 94. In other embodiments, the primary fixed cutting blades (e.g., primary fixed cutting blades 23, 25, 27) may extend to and/or slightly into the cone region (e.g., cone region 94). In this embodiment, as illustrated, each of the primary fixed cutting blades 23, 25 and 27, and each of the roller-cone cutters 29, 31, 33 extends substantially to gage region 96 and outer radius 92. However, in other embodiments, one or more primary fixed cutting blades 23, 25, 27, and one or more roller-cone cutters 29, 31, 33, may not extend completely to the gage region 96 or outer radius 92 of the drill bit 11.

With continued reference to FIG. 5, each primary fixed cutter blade 23, 25, 27 and each secondary fixed cutter blade 61, 63, 65 generally tapers (e.g., becomes thinner) in top view as it extends radially inward toward central axis 15. Consequently, both the primary and secondary fixed cutter blades 23, 25, 27 and 61, 63, 65, respectively, are relatively thin proximal axis 15 where space is generally limited circumferentially, and widen as they extend outward from the axial centerline 15 toward gage region 96. Although primary fixed-cutter blades 23, 25, 27 and secondary fixed-cutter blades 61, 63, 65 extend linearly in the radial direction in top view, in other embodiments, one or more of the primary fixed cutting blades, one or more of the secondary fixed cutting blades, or combinations thereof may be arcuate (concave or convex) or curve along their length in top view.

With continued reference to FIG. 5, primary fixed-blade cutter elements 41, 43, 45 are provided on each primary fixed cutting blade 23, 25, 27 in regions 94, 95, 96, and secondary fixed-blade cutter elements 40 (see FIG. 4) are provided on each secondary fixed-cutter blade in regions 94, 95, and 97. However, in this embodiment, backup cutter elements 47, 49, 51 are only provided on primary fixed-cutter blades 23, 25, 27 (i.e., no backup cutter elements are provided on secondary fixed-cutter blades 61, 63, 65). Thus, secondary fixed-cutter blades 61, 63, 65, and regions 94 and 97 of primary fixed-cutter blades 23, 25, 27 of drill bit 11 are substantially free of backup cutter elements.

Figure 9A:
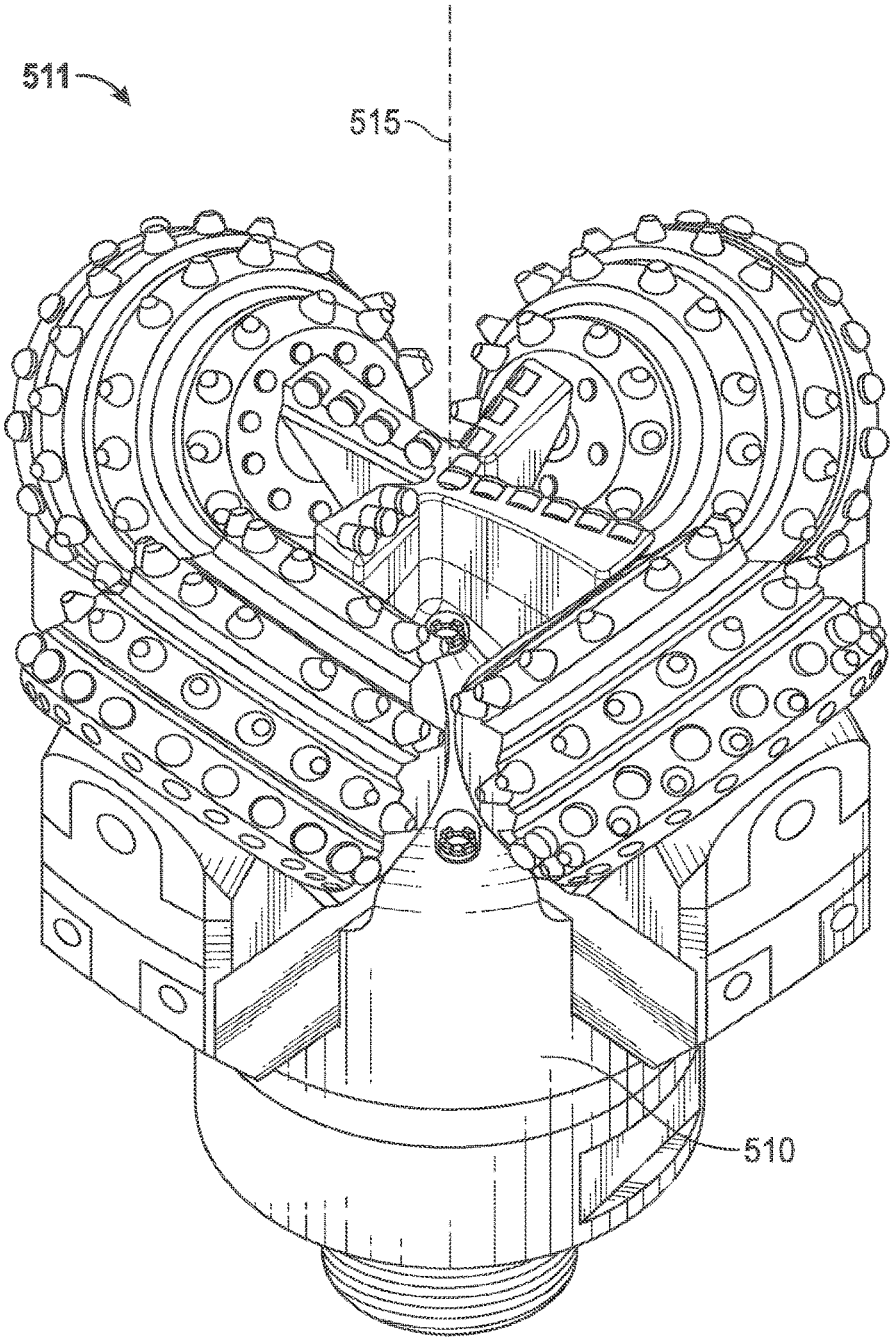
FIG. 9A illustrates an isometric perspective view of an exemplary drill bit in accordance with further aspects of the present disclosure.
Figure 9B:
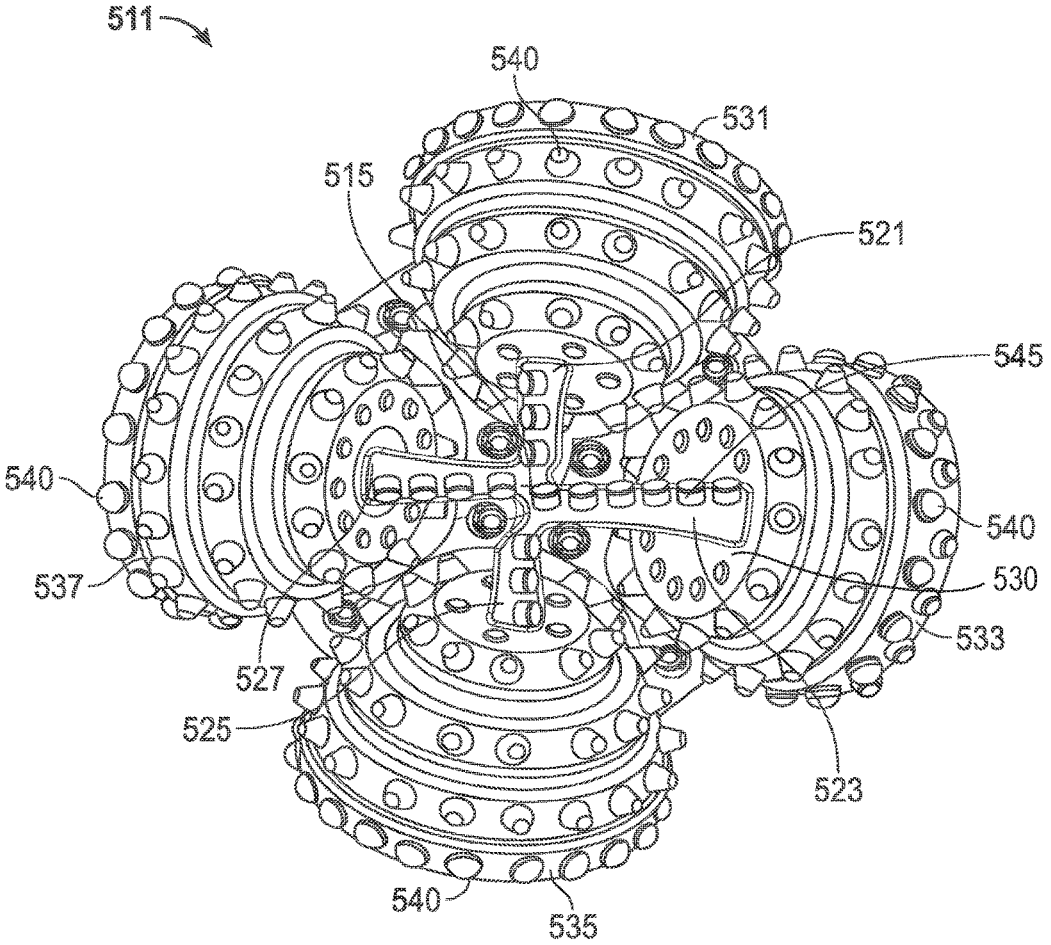
FIG. 9B illustrates a top view of the drill bit of FIG. 9A.

A further alternative arrangement between fixed-cutter blades and roller cutters in accordance with the present disclosure is illustrated in FIGS. 9A and 9B. Therein, a drill bit 511 is shown that includes, on its working end, and extending upwardly from bit face 510 in the direction of the central axis 515 of the bit, four secondary fixed-cutter blades 521, 523, 525, 527 having a plurality of fixed-blade cutting elements 545 attached to at least the leading edge thereof (with respect to the direct of rotation of the bit 511 during operation), and four roller-cone cutters 531, 533, 535, 537 having a plurality of roller-cone cutting elements 540 attached thereto. Each of the four secondary fixed-cutter blades (521, 523, 525, 527) are arranged approximately 90 degrees apart from each other; similarly, each of the four roller-cone cutters (531, 533, 535, 537) are arranged approximately 90 degrees apart from each other, and in alignment with the central axis of each the respective secondary fixed-cutter blades. Each of the secondary fixed-cutter blades 521, 523, 525, 527 extends radially outward from proximate the bit axis 515 towards nose region 97 of bit face 510, extending substantially the extent of cone region 94 (see FIG. 4). In a like manner, each of the four roller-cone cutters 531, 533, 535, 537 extend radially outward from approximately nose region 97 through shoulder region 95 and gage region 96 toward outer radius 92 of drill bit 511 (see FIG. 5). As in previous embodiments, top or apex face 530 of each of the roller-cone cutters 531, 533, 535, 537 is proximate to, but not in direct contact with (a gap or void 90 being present (see FIG. 5)) the terminal, furthest extending end of the secondary fixed-blade cutter to which it is substantially angularly or linearly aligned.

The drill bits in accordance with the previously described figures have illustrated that the roller-cone cutters are not in direct contact with the distal end of any of the secondary fixed-cutter blades to which they are in alignment, a space, gap or void 90 being present to allow the roller-cone cutters to turn freely during bit operation. This gap 90, extending between the top face of each truncated roller-cone cutter and the distal end (the end opposite and radially most distant from the central axis of the bit), is preferably sized large enough such that the gap's diameter allows the roller-cone cutters to turn, but at the same time is small enough to prevent debris from the drilling operation (e.g., cuttings from the fixed cutting blade cutting elements, and/or the roller-cone cutting elements) to become lodged therein and inhibit free rotation of the roller-cone cutter. Alternatively, and equally acceptable, one or more of the roller cutter cones could be mounted on a spindle or linear bearing assembly that extends through the center of the truncated roller-cone cutter and attaches into a saddle or similar mounting assembly either separate from or associated with a secondary fixed-blade cutter. Further details of this alternative arrangement between the roller-cone cutters and the secondary fixed blades are shown in the embodiments of the following figures.

Figure 10:
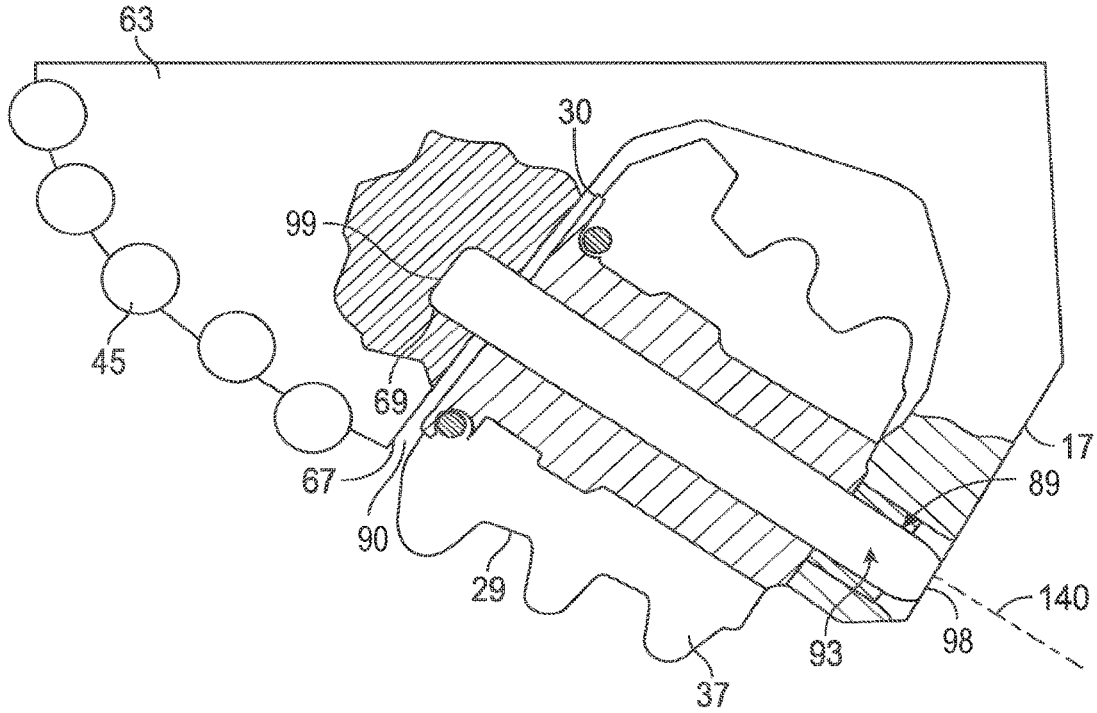
FIG. 10 illustrates a partial cross-sectional view of the drill bit of FIG. 1, showing an alternative embodiment of the present disclosure.

Turning now to FIG. 10, a cross-sectional view of an alternative arrangement between roller-cone cutter 29 and secondary fixed-blade cutter 63, such as illustrated in FIGS. 1, 2 and 3, is shown. In the cross-sectional view, the apex end face 30 of the rolling-cone cutter 29 is proximate to, and substantially parallel to, the outer distal edge face 67 of secondary fixed-blade cutter 63. In accordance with one aspect of this embodiment, the roller-cone cutter 29 and the secondary fixed-blade cutter 63 are proximate each other, but do not directly abut, there being a space or gap 90 therebetween allowing the roller-cone cutter 29 to continue to turn about its central longitudinal axis 140 during operation. As further illustrated in the cross-sectional view of this embodiment, a saddle-type assembly between the secondary fixed-blade cutter 63 and the roller-cone cutter 29 is shown in partial cutaway view. As shown therein, the roller-cone cutter 29 includes a linear bearing shaft 93 having a proximal end 98 and a longitudinally opposite distal end 99, and which extends along the central axial axis 140 of the roller-cone cutter 29, from the outer edge of the bit leg 17 inwardly through the central region of roller-cone cutter 29, and into a recess 69 formed within the distal face 67 of secondary fixed cutter blade 63. That is, the bearing shaft 93 extends through the roller-cone cutter 29 and projects into, and is retained within (via appropriate retaining means such as a threadable receiving assembly within recess 69 shaped to threadably mate with a male-threaded distal end 99 of bearing shaft 93) the distal face 67 of the secondary fixed-blade cutter 63. The bearing shaft 93 may also be removably secured in place via an appropriate retaining means 89. Accordingly, during operation, the rolling-cone cutter 29 turns about bearing shaft 93. This particular embodiment is useful when, for example, rolling-cone cutter 29 needs to be replaced during bit operation, due to a more rapid rate of wear on the rolling cutters versus the fixed blades. In such a situation, the user may remove bearing shaft 93, thereby releasing the rolling-cone cutter 29, and insert a new rolling-cone cutter into place, thereby saving the time typically necessary to remove and replace worn rolling cutters on a bit face. While bearing shaft 93 is illustrated as being substantially cylindrical and of uniform diameter throughout its length, bearing shaft 93 may also be tapered in some aspects of the disclosure. Another embodiment allows for a spindle 53 (see FIG. 4) of a roller-cone cutter to extend through the inner end of the roller cone and the extension of the spindle is secured, either directly or indirectly, to or within the secondary fixed cutting blade, to a separate saddle-bearing mount assembly, or to or within the bit body 13. This is illustrated in FIGS. 11-16.

Figure 11:
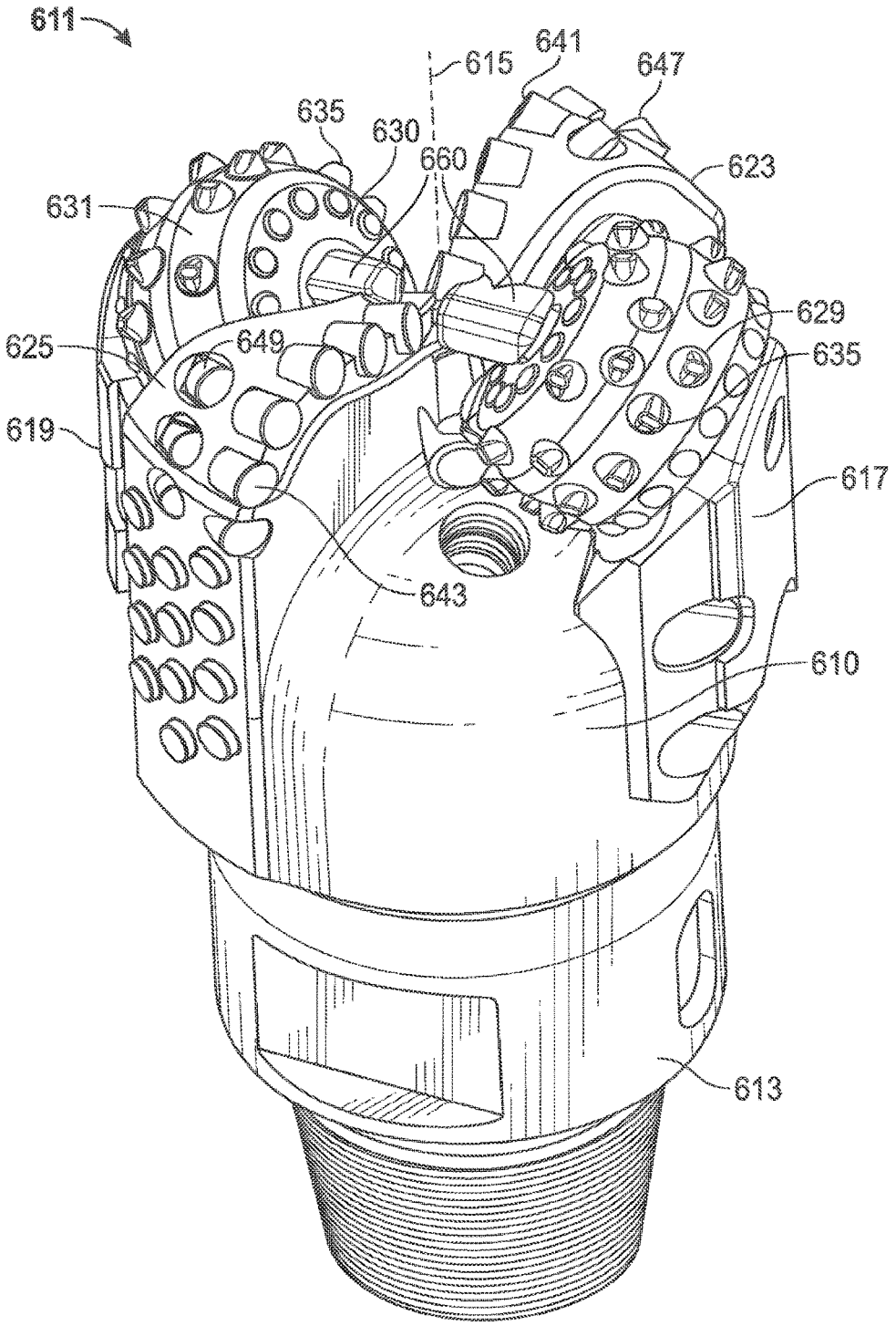
FIG. 11 illustrates an isometric perspective view of a further exemplary drill bit in accordance with embodiment of the present disclosure.
Figure 12:
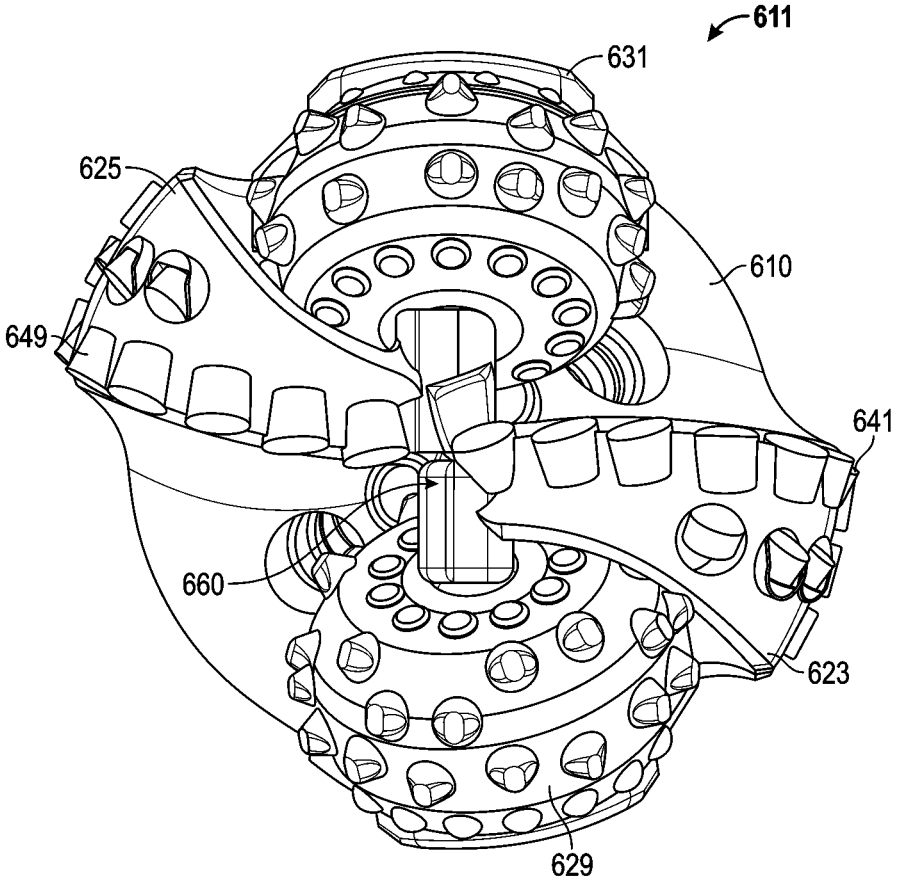
FIG. 12 illustrates a top view of the drill bit of FIG. 11.
Figure 13:
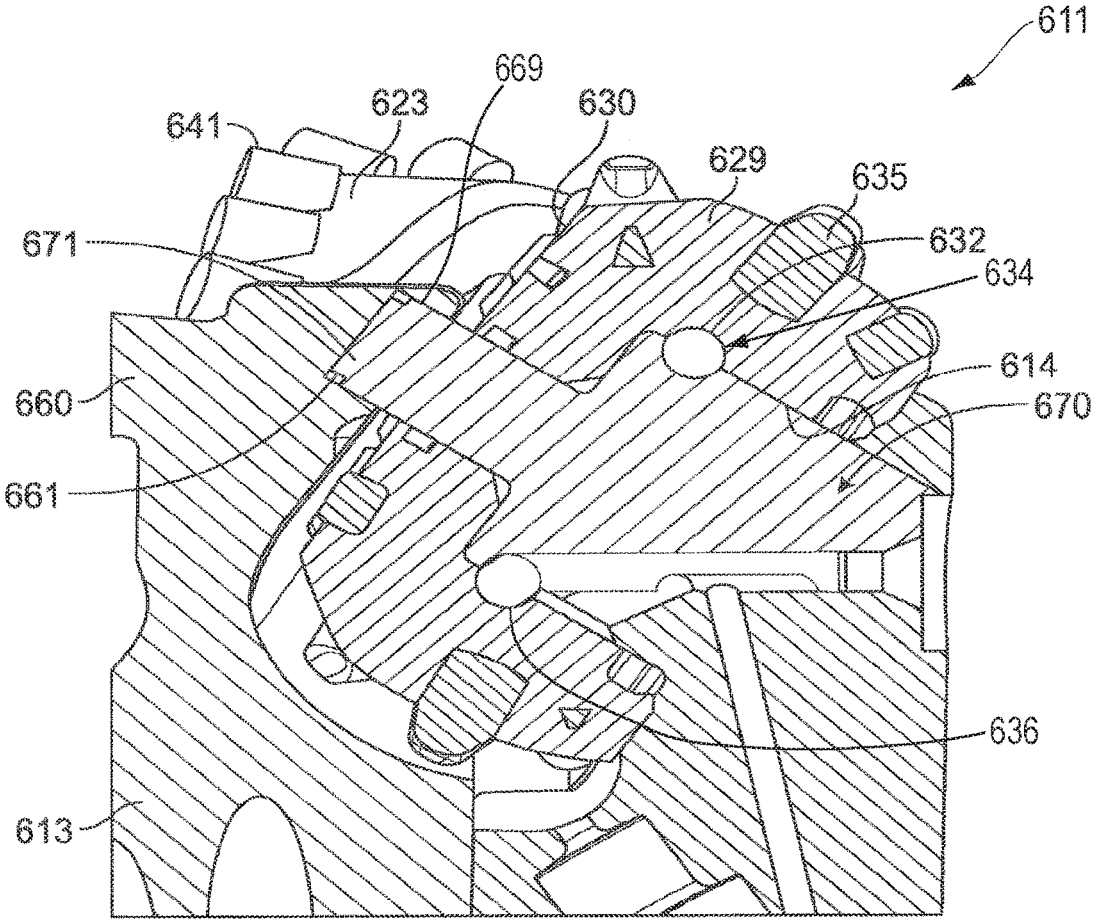
FIG. 13 illustrates a partial cross-sectional view of the drill bit of FIG. 11, showing the bearing assembly and saddle-mount assembly in conjunction with a roller cone.
Figure 14:
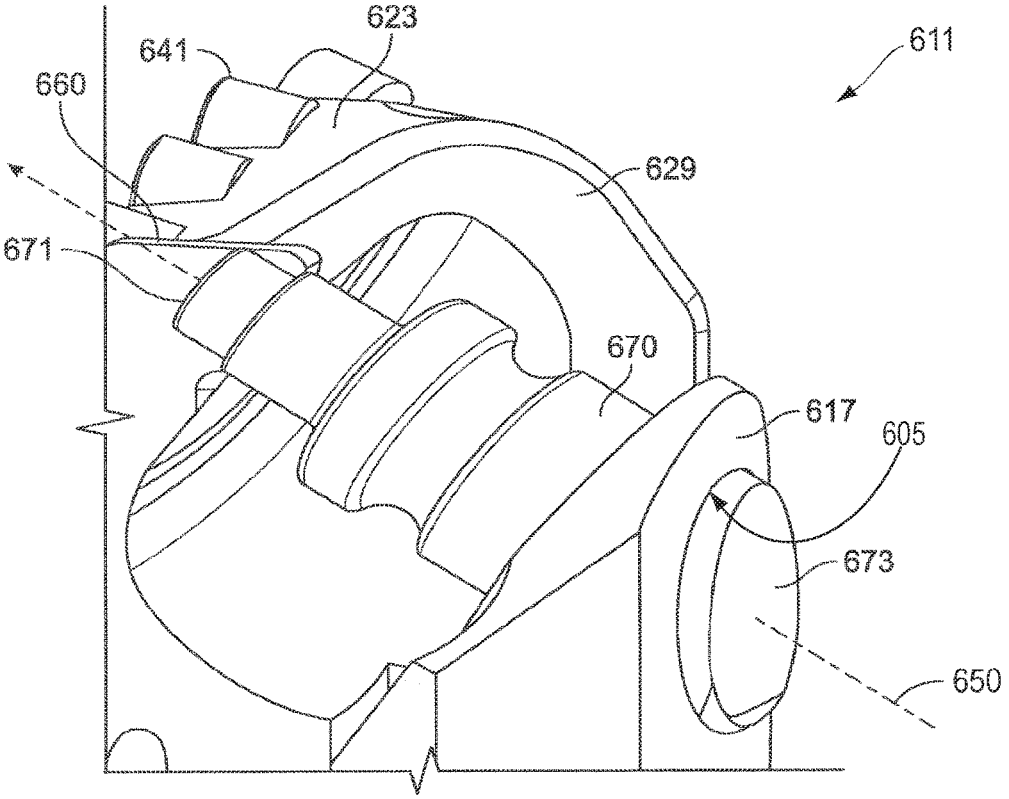
FIG. 14 illustrates a partial cutaway view of the cross-sectional view of FIG. 13.
Figure 15:
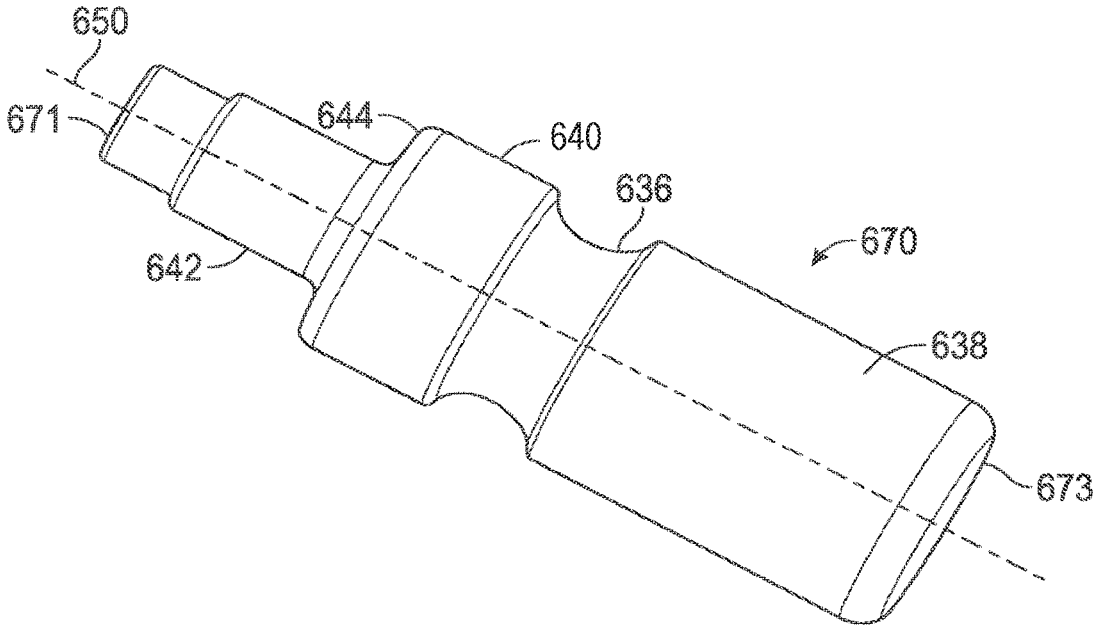
FIG. 15 illustrates a perspective view of an exemplary extended spindle in accordance with aspects of the present disclosure.
Figure 16:
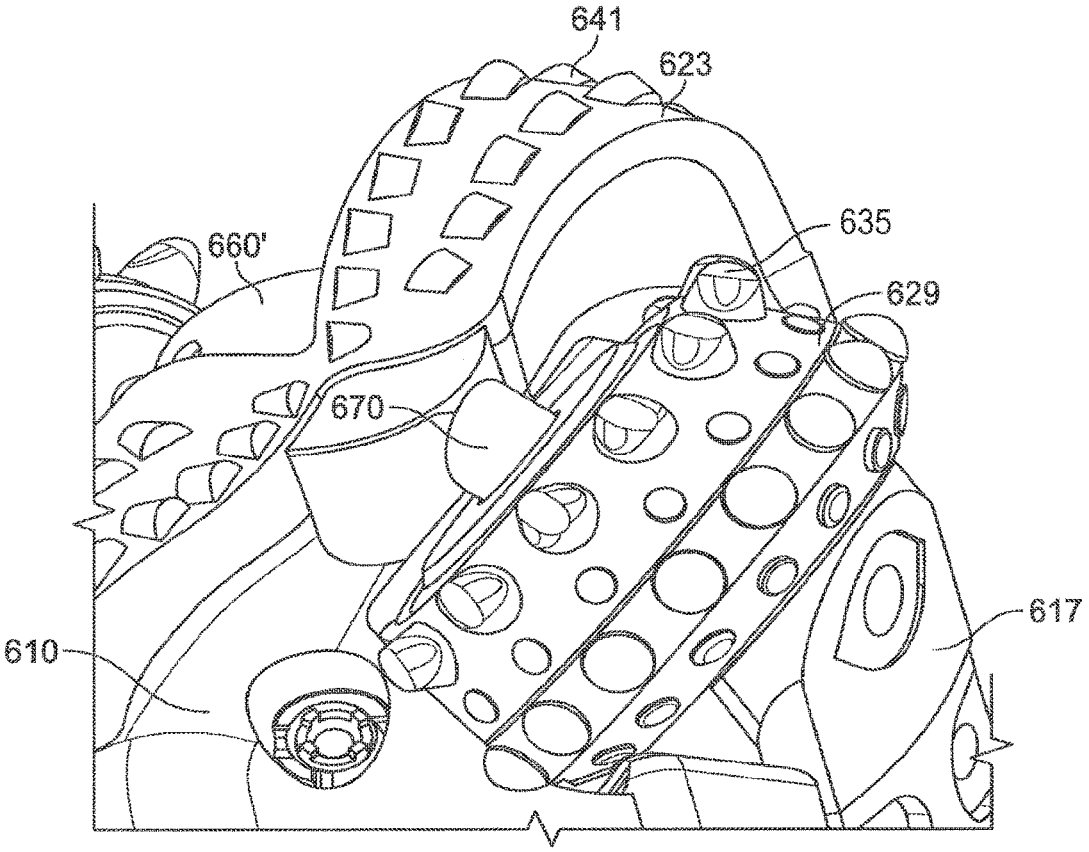
FIG. 16 illustrates a detailed perspective view of an exemplary saddle-mount assembly in accordance with the present disclosure.

FIG. 11 illustrates an isometric perspective view of a further exemplary drill bit 611 in accordance with embodiments of this disclosure. FIG. 12 illustrates a top view of the drill bit of FIG. 11. FIG. 13 illustrates a partial cross-sectional view of a roller-cone cutter assembly, secondary fixed blade, and saddle-bearing assembly in accordance with FIGS. 11 and 12. FIG. 14 illustrates a partial cut-away view of the assembly of FIG. 13. FIG. 14 illustrates an exemplary extended, pass-through spindle bearing 670. FIG. 15 illustrates a partial top perspective view of a saddle-bearing assembly. These figures will be discussed in combination with each other.

FIG. 11 is an isometric view of drill bit 611. FIG. 12 is a top view of the same hybrid drill bit. As shown in FIG. 11, drill bit 611 includes a bit body 613. Bit body 613 is substantially similar to the bit bodies previously described herein, except that the working (lower) end of the drill bit includes only two roller-cone cutters 629, 631 attached to bit legs 617, 619 mounted to the bit face 610, and two fixed-blade cutters 623, 625, although FIG. 11 is not meant to limit the disclosure, and combinations including three and four fixed-blade cutters and roller-cone cutters are envisioned. Both the roller-cone cutters 629, 631 and the fixed-blade cutters are arranged substantially opposite (approximately 180 degrees apart) from each other about central bit axis 615, and each include a plurality of roller cutter cutting elements 635, and fixed-blade cutting elements 641, 643. The drill bit 611 further includes a shaped saddle-mount assembly 660 proximate the central axis 615 of the drill bit and providing a means by which the spindle (not shown) extends through the roller-cone cutters 629, 631 and is retained at its distal end. While the saddle-mount assembly 660 is shown to be generally rectangular or downwardly tapered toward bit face 610 (FIG. 12), or cylindrical in shape (saddle-mount assembly 660' of FIG. 16), the saddle-mount assembly 660 may be of any appropriate shape as dictated by the overall design of the drill bit, including the type of formation the bit will be used in, the number of roller cutters employed, and the number of primary and secondary fixed-blade cutters are included in the overall bit design.

FIG. 13, is a schematic drawing in sections with portions broken away showing hybrid drill bit 611 with support arms or bit legs 617, 619 and roller-cone cutter assemblies 629, 631 having pass-through bearing systems incorporating various teachings of this disclosure. Various components of the associated bearing systems, which will be discussed later in more detail, allow each roller-cone cutter assembly 629, 631 to be rotatably mounted on its respective journal or spindle 670, which passes through the interior region of the roller-cone cutter assemblies 629, 631 and into a shaped-retaining recess 669.

Roller-cone cutter assemblies 629, 631 of drill bit 611 may be mounted on a journal or spindle 670 projecting from respective support arms 617, 619, through the interior region of the roller-cone cutter assemblies 629, 631, and into a recess within saddle-mount assembly 660 and its distal end 671 using substantially the same techniques associated with mounting roller-cone cutters on a standard spindle or journal 53 projecting from respective support arms 19, as discussed previously herein with reference to FIG. 4. Also, a saddle-mount assembly system incorporating teachings of this disclosure may be satisfactorily used to rotatably mount roller-cone cutter assemblies 629, 631 on respective support arms 617, 619 in substantially the same manner as is used to rotatably mount roller-cone cutter assemblies on respective support arms as is understood by those of skill in the art.

With continued reference to FIG. 13, each rolling-cone cutter assembly 629 preferably includes generally cylindrical cavity 614 that has been sized to receive spindle or journal 670 therein. Each rolling-cone cutter assembly 629 and its respective spindle 670 has a common longitudinal axis 650 (see FIG. 14) that also represents the axis of rotation for rolling-cone cutter assembly 629 relative to its associated spindle 670. Various components of the respective bearing system include machined surfaces associated with the interior of cavity 614 and the exterior of spindle 670. These machined surfaces will generally be described with respect to axis 650.

For the embodiments shown in FIGS. 13, 14, 15 and 16, each roller-cone cutter assembly 629, 631 is retained on its respective journal by a plurality of ball bearings 632. However, a wide variety of cutter cone assembly retaining mechanisms that are well known in the art, may also be used with a saddle-mount spindle retaining system incorporating teachings of this disclosure. For the example shown in FIG. 13, ball bearings 632 are inserted through an opening in the exterior surface of the bit body 13 or bit leg, and via a ball retainer passageway of the associated bit leg 617, 619 (see FIG. 11). Ball races 634 and 636 are formed respectively in the interior of cavity 614 of the associated roller-cone cutter assembly 629 and the exterior of spindle 670.

Each spindle or journal 670 is formed on inside surface 605 of each bit leg 617, 619. Each spindle 670 has a generally cylindrical configuration (FIG. 15) extending along axis 650 from the bit leg. The spindle 670 further includes a proximal end 673 that when the spindle 670 is inserted into bit 611 and through roller-cone cutter assembly 629, will be proximal to the interior of the appropriate bit leg 617, 619. Opposite from proximal end 673 is distal end 671, which may be tapered or otherwise shaped or threaded so as to be able to mate with and be retained within a recess within saddle-mount assembly 660. Axis 650 also corresponds with the axis of rotation for the associated roller-cone cutter 629, 631. For the embodiment of this disclosure as shown in FIG. 13, spindle 670 includes first outside diameter portion 638, second outside diameter portion 640, and third outside diameter portion 642.

With continued reference to FIGS. 13-15, first outside diameter portion 638 extends from the junction between spindle 670 and inside surface 605 of bit leg 617 to ball race 636. Second outside diameter portion 640 extends from ball race 636 to shoulder 644 formed by the change in diameter from second outside diameter portion 640 to third outside diameter portion 642. First outside diameter portion 638 and second outside diameter portion 640 have approximately the same diameter measured relative to the axis 650. Third outside diameter portion 642 has a substantially reduced outside diameter in comparison with first outside diameter portion 638 and second outside diameter portion 640. Cavity 614 of roller-cone cutter assembly 629 preferably includes a machined surface corresponding generally with first outside diameter portion 638, second outside diameter portion 640, third outside diameter portion 642, shoulder 644 and distal end portion 671 of spindle 670.

With continued reference to FIGS. 13, 14, and 15, first outside diameter portion 638, second outside diameter portion 640, third outside diameter portion 642 and corresponding machined surfaces formed in cavity 614 provide one or more radial bearing components used to rotatably support roller-cone cutter assembly 629 on spindle 670. Shoulder 644 and end 673 (extending above the top face 630 of roller-cone cutter 629 and into a recess 661 formed in bearing saddle-mount assembly 660) of spindle 670 and corresponding machined surfaces formed in cavity 614 provide one or more thrust-bearing components used to rotatably support roller-cone cutter assembly 629 on spindle 670. As will be understood by those of skill in the art, various types of bushings, roller bearings, thrust washers, and/or thrust buttons may be disposed between the exterior of spindle 670 and corresponding surfaces associated with cavity 614. Radial-bearing components may also be referred to as journal-bearing components, as appropriate.

With reference to FIGS. 13 and 14, the overall assembly of the pass-through spindle 670 into saddle-mount assembly 660 can be seen. In particular, a recess 661 is preferably formed into the body of the saddle-mount assembly 660, the recess 661 being in axial alignment with the longitudinal, rotational axis 650 of the roller-cone cutter 629. Recess 661 is shaped to receive distal end 671 of spindle 670. The spindle 670 may be retained within recess 661 by a suitable retaining means (screw threads, pressure retention, or the like) as appropriate to prevent spindle 670 from rotating as the roller-cone cutter 629 rotates during bit operation. In an alternative arrangement, however, distal end 671 of spindle 670 is shaped to readily fit within the machined walls of recess 661 of saddle-mount assembly 660, which may further optionally include one or more radial bearings, so as to allow spindle 670 to rotate freely about its longitudinal axis during bit operation as appropriate.

Other features of the hybrid drill bits such as backup cutters (647, 649), wear-resistant surfaces, nozzles that are used to direct drilling fluids, junk slots that provide a clearance for cuttings and drilling fluid, and other generally accepted features of a drill bit are deemed within the knowledge of those with ordinary skill in the art and do not need further description, and may optionally and further be included in the drill bits of this disclosure.

Figure 17:
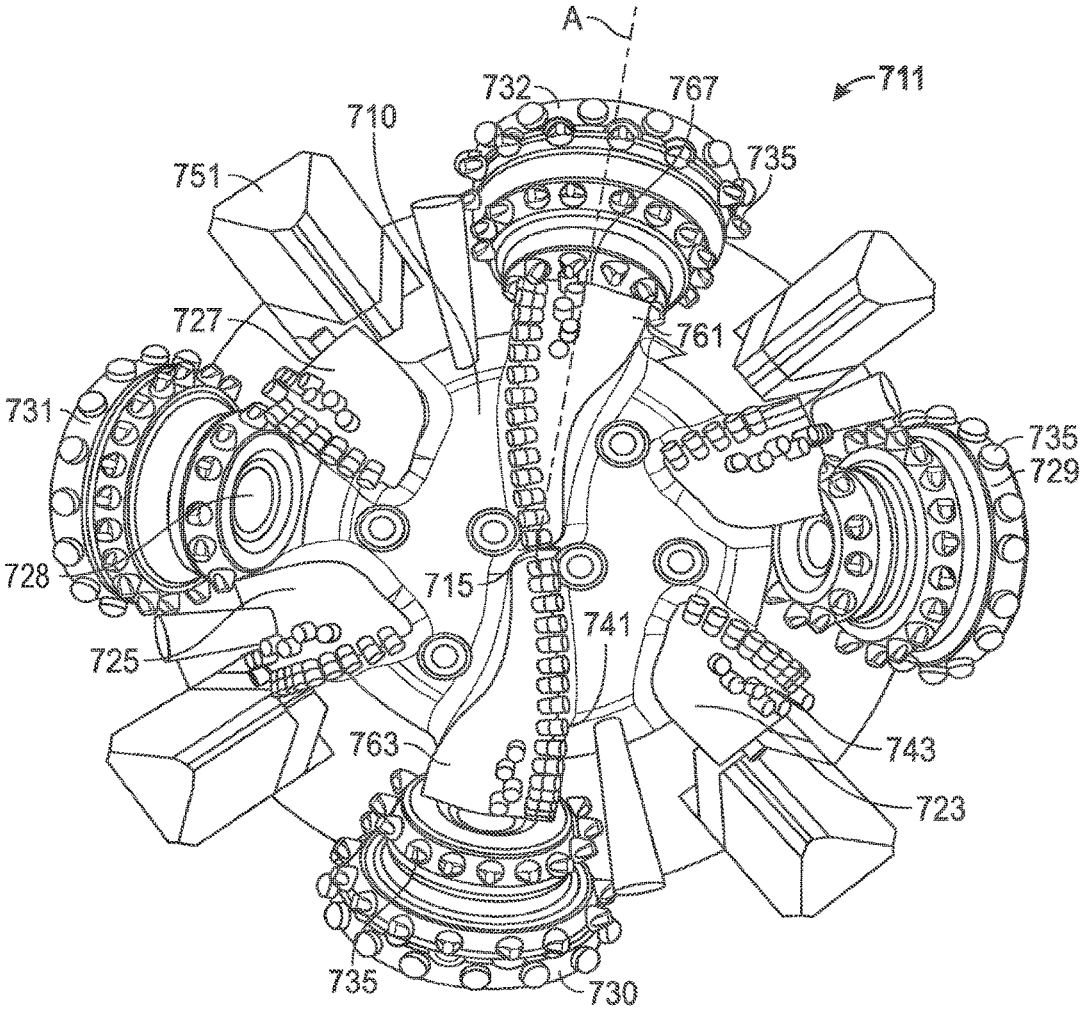
FIG. 17 illustrates a top down view of a further embodiment of the present disclosure, showing an exemplary hybrid reamer drill bit.
Figure 18:
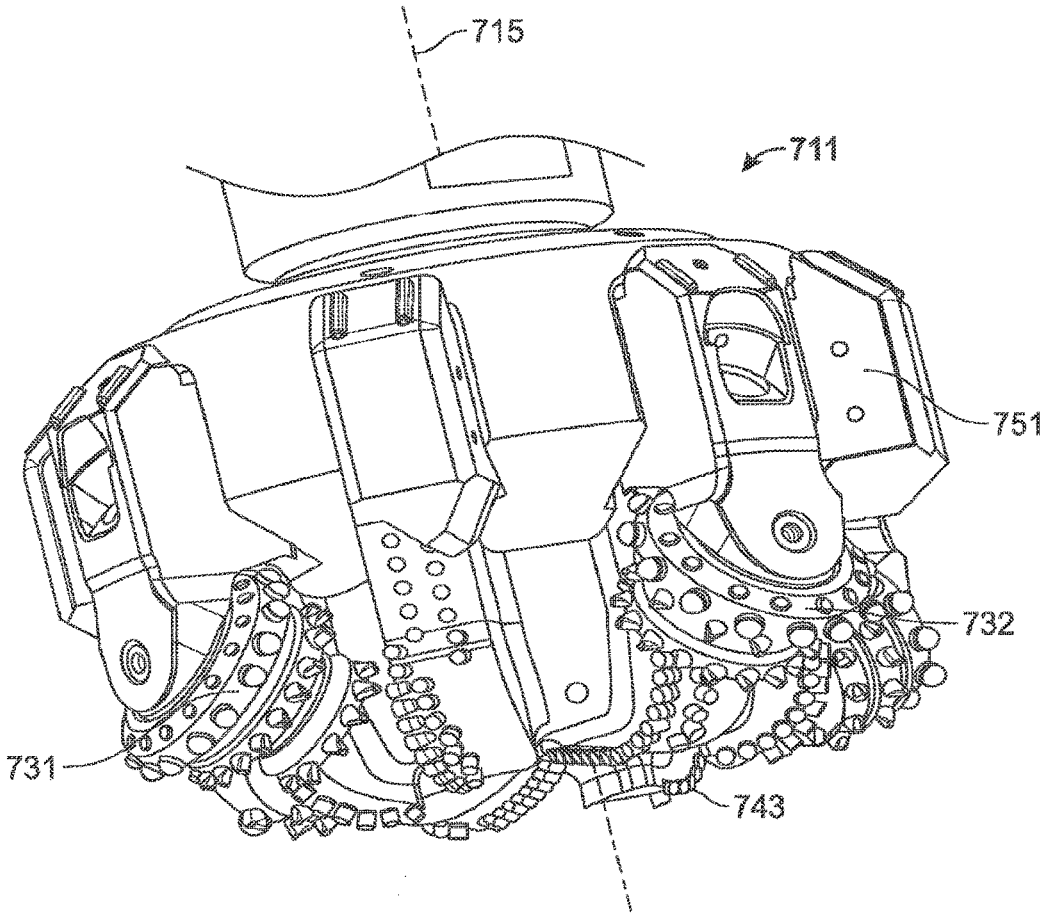
FIG. 18 illustrates side perspective view of the hybrid reamer drill bit of FIG. 17.
Figure 19:
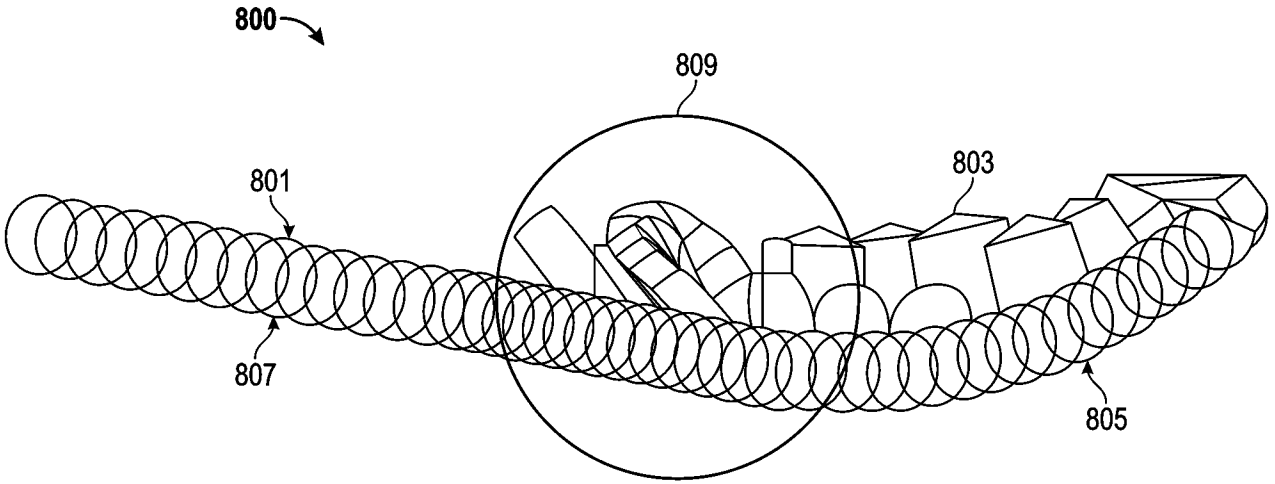
FIG. 19 illustrates a partial composite, rotational side view of the roller cone inserts and the fixed cutting elements on the hybrid reamer drill bit of FIG. 17.

Turning now to FIGS. 17-19, further alternative embodiments of the present disclosure are illustrated. As shown therein, the drill bit may be a hybrid-type reamer drill bit, incorporating numerous of the above-described features, such as primary and secondary fixed-blade cutters, wherein one of the fixed cutters extends from substantially the drill bit center toward the gage surface, and wherein the other fixed cutter extends from the gage surface inwardly toward the bit center, but does not extend to the bit center, and wherein at least one of the first fixed cutters abuts or approaches the apex of at least one rolling cone. FIG. 17 illustrates a bottom, working face view of such a hybrid reamer drill bit, in accordance with embodiments of the present disclosure. FIG. 18 illustrates a side, cutaway view of a hybrid reamer drill bit in accordance with the present disclosure. FIG. 19 illustrates a partial isometric view of the drill bit of FIG. 17. These figures will be discussed in combination with each other.

As shown in these figures, the hybrid reamer drill bit 711 comprises a plurality of roller-cone cutters 729, 730, 731, 732 frustoconically shaped or otherwise, spaced apart about the working face 710 of the drill bit. Each of these roller-cone cutters comprises a plurality of cutting elements 735 arranged on the outer surface of the cutter, as described above. The bit 711 further comprises a series of primary fixed-blade cutters, 723, 725, 727, which extend from approximately the outer gage surface of the bit 711 inwardly toward, but stopping short of, the axial center 715 of the bit 711. Each of these primary fixed-blade cutters 723, 725, 727 may be fitted with a plurality of cutting elements 741 and, optionally, backup cutters 743, as described in accordance with embodiments described herein. The drill bit 711 may further include one or more (two are shown) secondary fixed-blade cutters 761, 763 that extend from the axial center 715 of the drill bit 711 radially outward toward roller-cone cutters 730, 732, such that the outer, distal end 767 of the secondary fixed-blade cutters 761, 763 (the end opposite that proximate the axial center 715 of the bit 711) abuts, or is proximate to, the apex or top face 728 of the roller-cone cutters 730, 732. The secondary fixed-blade cutters 761, 763 are preferably positioned so as to continue the cutting profile of the roller-cone cutter to which they proximately abut at their distal end, extending the cutting profile toward the center region of the drill bit 711. A plurality of optional stabilizers 751 is shown at the outer periphery, or in the gage region, of the bit 711; however, it will be understood that one or more of them may be replaced with additional roller-cone cutters, or primary fixed-blade cutters, as appropriate for the specific application in which the bit 711 is being used. Further, in accordance with aspects of the present disclosure, the roller-cone cutters are positioned to cut the outer diameter of the borehole during operation, and do not extend to the axial center, or the cone region, of the drill bit. In this manner, the roller-cone cutters act to form the outer portion of the bottom hole profile. The arrangement of the roller-cone cutters with the secondary fixed cutters may also, or optionally, be in a saddle-type attachment assembly, similar to that described in association with FIGS. 10 and 11, above.

FIG. 19 illustrates a schematic representation of the overlap/superimposition of fixed cutting elements 801 of fixed-blade cutter 761 (not shown) and the cutting elements 803 of rolling cutter 732 (also not shown), and how they combine to define a bottom hole cutting profile 800, the bottom hole cutting profile 800 including a bottom hole cutting profile 807 of the fixed-blade cutter and a bottom hole cutting profile 805 of the rolling cutter 732. The bottom hole cutting profile extends from the approximate axial center 715 to a radially outermost perimeter with respect to the central longitudinal axis. Circled region 809 is the location where the bottom hole cutting coverage from the roller-cone cutting elements 803 stops, but the bottom hole cutting profile continues. In one embodiment, the cutting elements 801 of the secondary fixed-blade cutter 761 forms the cutting profile 807 at the axial center 715, up to the nose or shoulder region, while the roller-cone cutting elements 803 extend from the outer gage region of the drill bit 711 inwardly toward the shoulder region, without overlapping the cutting elements of the fixed-blade cutter, and defining the second cutting profile 805 to complete the overall bottom hole cutting profile 800 that extends from the axial center 715 outwardly through a "cone region," a "nose region," and a "shoulder region" (see FIG. 5) to a radially outermost perimeter or gage surface with respect to the axis 715. In accordance with other aspects of this embodiment, at least part of the roller-cone cutting elements and the fixed-blade cutter cutting elements overlap in the nose or shoulder region in the bit profile.

Figure 20:
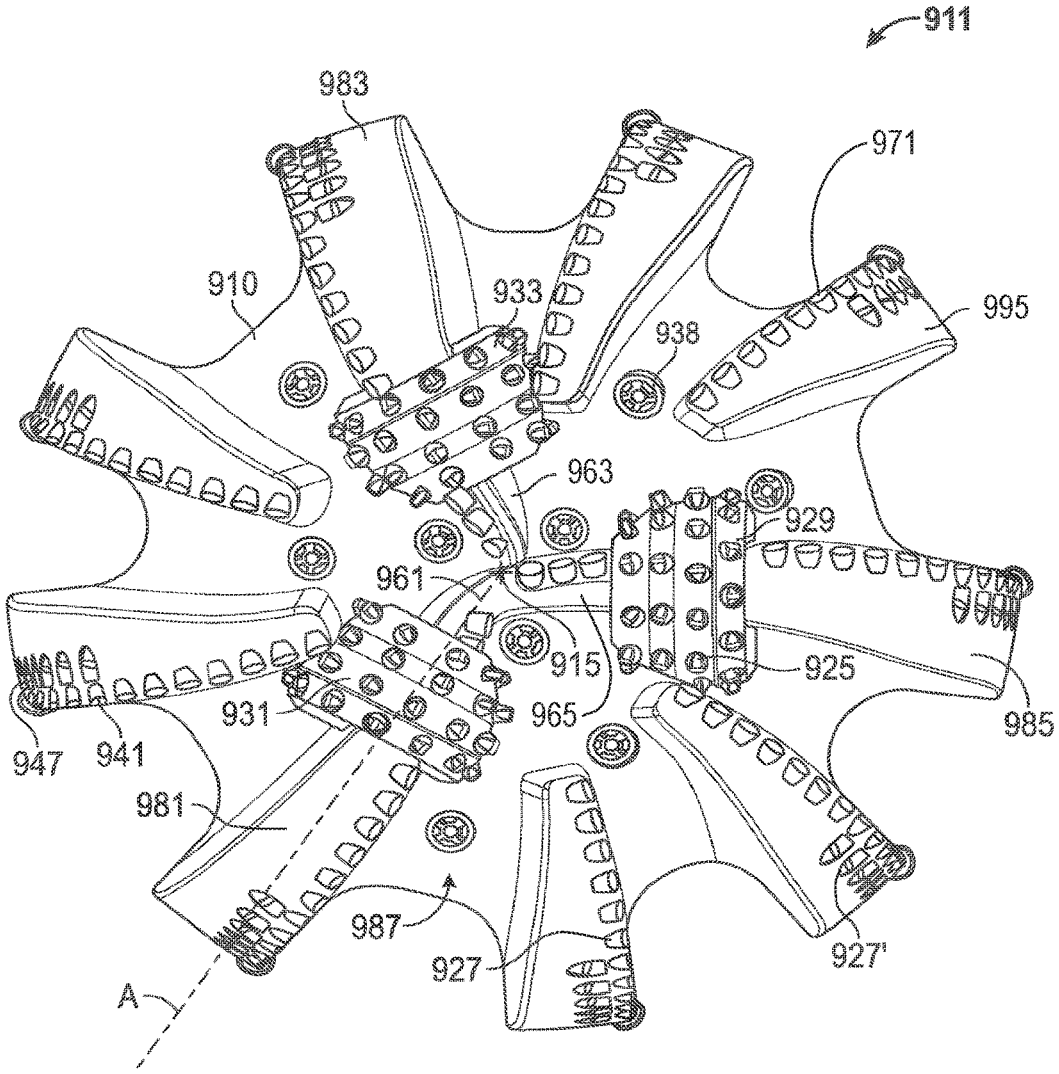
FIG. 20 illustrates a schematic isometric view of an exemplary drill bit in accordance with embodiments of the present disclosure.

Turning to FIG. 20, a further alternative drill bit configuration in accordance with aspects of the present disclosure is illustrated. Exemplary earth-boring drill bit 911 is a larger-diameter drill bit of the type that is used, for example, to drill large-diameter boreholes into an earthen formation. Typically, such bits are designed in diameter ranges from approximately 28 inches to 144 inches and larger. Such large-diameter drill bits often exhibit steerability control issues during their use. Drill bit 911 includes a bit face 910 and an axial center 915. The bit face 910 further includes at least one junk slot 987, and a plurality of nozzles 938, similar to those discussed previously herein. A plurality of primary fixed-blade cutters 981, 983, 985 extends downwardly from bit face 910 in the axial direction and is arranged about the bit face 910 of drill bit 911 and is associated with roller-cone cutters and corresponding secondary fixed-blade cutters. Similarly, a plurality of secondary fixed-blade cutters 961, 963, 965 extends downwardly from bit face 910 in the axial direction, and radiates outwardly from proximate the axial axis 915 toward the gage region of bit 911. Primary and secondary fixed-blade cutters, and their characteristics, have been discussed previously herein with reference to FIGS. 3-5. Additional primary fixed-blade cutters 995, which are not directly associated with secondary fixed-blade cutters 961, 963, 965, may also be included on drill bit 911. The primary and secondary fixed-blade cutters have leading and trailing edges, and include at least one, and preferably a plurality of, fixed-blade cutting elements 927, 941, 971 spaced generally along the upper edge of the leading edge of the fixed-blade cutters 995. Primary fixed-blade cutters 981, 983, 985 may further, optionally include one or more backup cutting elements 927', 947.

Similar to other hybrid drill bits described herein, drill bit 911 further includes at least one, and preferably a plurality of (three are shown) roller-cone cutters 929, 931, 933, each having a plurality of rolling-cone cutting elements 925 arranged, circumferentially or non-circumferentially, about the outer surface of the roller-cone cutters 929, 931, 933. In order to address the steerability issues associated with such wide diameter drill bits like bit 911, the at least one, and preferably a plurality of, roller-cone cutters 929, 931, 933 are located intermediate between a primary fixed-blade cutter and a secondary fixed-blade cutter, in an angular or linear alignment with each other along, or substantially along, an angular alignment line "A". As discussed above, the roller-cone cutters 929, 931, 933 and the secondary fixed-blade cutters 961, 963, 965 are not in direct facial contact, but the distal face of the secondary fixed-blade cutters 961, 963, 965 is proximate to the apex face (not shown) of the (preferably) truncated roller-cone cutter. Similarly, the inwardly directed (in the direction of the bit axis 915) face of a corresponding primary fixed-blade cutter is proximate a bottom face of a roller-cone cutter located between a primary and secondary fixed-blade cutter, in substantial angular alignment. The secondary fixed-blade cutters 961, 963, 965 may be of any appropriate length radiating outwardly from proximal the bit axis 915, such that the roller-cone cutters 929, 931, 933 overlap the gage and shoulder region of the bit profile, or the nose and shoulder region of the bit profile, so that as the roller-cone cutters 929, 931, 933 turn during operation, force is exterted toward the cone region of the drill bit 911 to aid in bit stabilization.

The intermediate roller-cone cutters 929, 931, 933 are held in place by any number of appropriate bearing means or retaining assemblies including, but not limited to, centrally-located cylindrical bearing shafts extending through the core of the roller-cone cutter and into recesses formed in the end faces of the respective primary and secondary fixed-blade cutters, which the roller-cone cutter is located between. Such bearing shafts may optionally be tapered from one end toward the opposite end. Still further, the intermediately located roller-cone cutters 929, 931, 933 may be retained in position between the primary and secondary fixed-blade cutters 981, 983, 985 and 961, 963, 965, respectively, by way of a modified spindle assembly housed within the center of a roller-cone cutter and having an integral, shaped shaft extending from both ends of the (preferably truncated) roller-cone cutter and into mating recesses formed in a respective fixed-blade cutter.

Other and further embodiments utilizing one or more aspects of the disclosures described above can be devised without departing from the spirit of this disclosure. For example, combinations of bearing assembly arrangements, and combinations of primary and secondary fixed-blade cutters extending to different regions of the bit face may be constructed with beneficial and improved drilling characteristics and performance. Further, the various methods and embodiments of the methods of manufacture and assembly of the system, as well as location specifications, can be included in combination with each other to produce variations of the disclosed methods and embodiments. Discussion of singular elements can include plural elements and vice versa.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The disclosures have been described in the context of preferred and other embodiments and not every embodiment of the disclosure has been described. Obvious modifications and alterations to the described embodiments are available to those of ordinary skill in the art. The disclosed and undisclosed embodiments are not intended to limit or restrict the scope or applicability of the invention conceived of herein, but rather, in conformity with the patent laws, Applicants intend to fully protect all such modifications and improvements that come within the scope or range of equivalent of the appended claims.

What is claimed is:

1. An earth-boring drill bit comprising:

a bit body configured at its upper extent for connection to a drill string, the bit body having a central axis and a bit face comprising a cone region, a nose region, a shoulder region, and a radially outermost gage region;

at least one primary fixed blade extending downward from the bit body in the axial direction, the at least one primary fixed blade having a leading edge and a trailing edge and extending radially along the bit face;

a plurality of fixed-blade cutting elements arranged on the leading edge of the at least one primary fixed blade;

at least one secondary fixed blade extending downward from the bit body in the axial direction and having a leading edge and a trailing edge, the at least one secondary fixed blade extending radially outward along the bit face from proximate the bit axis through the cone region in substantial radial alignment with the at least one primary fixed blade; and at least one rolling cutter mounted for rotation between the at least one primary fixed blade and the at least one secondary fixed blade.

2. A method of drilling a wellbore in a subterranean formation, the method comprising:

drilling a wellbore into a subterranean formation using the earth-boring drill bit of claim 1.

3. The drill bit of claim 1, wherein the at least one primary fixed blade extends from the shoulder region to the gage region, the secondary fixed blade extends from the central axis through the cone region, and the axis of the at least one rolling cutter is radially aligned with the primary fixed-blade and the secondary fixed-blade.

4. The drill bit of claim 3, further comprising a bearing shaft within the at least one rolling cutter, the bearing shaft extending from the primary fixed blade through the at least one rolling cutter, wherein the bearing shaft extends through a top face of the at least one rolling cutter.

5. The drill bit of claim 4, further comprising the bearing shaft extending into the at least one secondary fixed blade.

6. The drill bit of claim 4, wherein the bearing shaft does not extend into the at least one secondary fixed blade.

7. The drill bit of claim 1, wherein the at least one primary fixed blade extends through the gage region, the at least one secondary fixed blade extends through the nose region, and wherein the axis of the at least one rolling cutter is radially aligned with the at least one primary fixed blade and the at least one secondary fixed-blade.

8. The drill bit of claim 7, further comprising a bearing shaft within the at least one rolling cutter, the bearing shaft extending from the at least one primary fixed blade through the at least one rolling cutter, wherein the bearing shaft extends through a top face of the at least one rolling cutter.

9. The drill bit of claim 8, further comprising the bearing shaft extending into the at least one secondary fixed blade.

10. The drill bit of claim 8, wherein the bearing shaft does not extend into the at least one secondary fixed blade.

11. The drill bit of claim 3, wherein the axis of rotation of the at least one rolling cutter is advanced from the central axis of the drill bit so the at least one rolling cutter tracks in an outwardly offset direction from the drill bit during drilling.

12. The drill bit of claim 3, wherein the axis of rotation of the at least one rolling cutter is retarded from the central axis of the drill bit so the at least one rolling cutter tracks in an inwardly offset direction from the drill bit during drilling.

13. A drill bit for earthen formations, comprising:

a bit body configured at its upper extent for connection to a drill string, the bit body having a central axis and a bit face including a cone region, a nose region, a shoulder region, and a radially outermost gage region;

at least one primary fixed-blade cutter extending downward from the bit body in the axial direction, the at least one primary fixed-blade cutter having a leading edge and a trailing edge and extending radially along the bit face from the shoulder region to the gage region;

a plurality of fixed-blade cutting elements arranged on the leading edge of the at least one primary fixed-blade cutter;

at least one secondary fixed-blade cutter extending downward from the bit body in the axial direction and having a leading edge and a trailing edge, the at least one secondary fixed-blade cutter extending radially outward along the bit face from proximate the bit axis through the cone region;

at least one rolling cutter mounted on a bit leg for rotation on the bit body and in substantial radial alignment with the at least one secondary fixed-blade cutter; and at least one rolling cutter mounted on a bit leg for rotation on the bit body and not in substantial radial alignment with any of the at least one primary fixed-blade cutter and the at least one secondary fixed-blade cutter.

14. The drill bit of claim 13, further comprising a bearing shaft within the at least one rolling cutter, the bearing shaft extending from the bit leg through the at least one rolling cutter, wherein the bearing shaft extends through a top face of the at least one rolling cutter.

15. The drill bit of claim 14, wherein at least one end of the bearing shaft is affixed to the bit body.

16. The drill bit of claim 14, wherein at least one end of the bearing shaft is affixed to the bit leg.

17. The drill bit of claim 14, wherein a distal end of the bearing shaft extends through the at least one rolling cutter and is removably secured, and a proximal end of the bearing shaft is removably secured to the bit leg.

18. The drill bit of claim 13, wherein the axis of rotation of the at least one rolling cutter is advanced from the central axis of the drill bit so the at least one rolling cutter tracks in an inwardly offset direction from the drill bit during operation.

19. The drill bit of claim 13, wherein the axis of rotation of the at least one rolling cutter is retarded from the central axis of the drill bit so the at least one rolling cutter tracks in an outwardly offset direction from the drill bit during operation.

20. A method of drilling a wellbore in a subterranean formation, the method comprising:

drilling a wellbore into a subterranean formation using the drill bit of claim 13.

* * * * *